US008087278B2

(12) United States Patent
Deis et al.

(10) Patent No.: US 8,087,278 B2
(45) Date of Patent: Jan. 3, 2012

(54) BENDING APPARATUS HAVING CHANGEABLE ANVILS AND RELATED METHODS

(75) Inventors: Robert M. Deis, Hudson, WI (US); Matthias Hoelle, Rheinhausen (DE)

(73) Assignee: Nela Ternes Register Group, Inc., Oakdale, MN (US)

( * ) Notice: Subject to any disclaimer, the term of this patent is extended or adjusted under 35 U.S.C. 154(b) by 584 days.

(21) Appl. No.: 12/291,008

(22) Filed: Nov. 5, 2008

(65) Prior Publication Data

US 2009/0126446 A1 May 21, 2009

Related U.S. Application Data

(60) Provisional application No. 61/001,848, filed on Nov. 5, 2007.

(51) Int. Cl.
*B21D 11/00* (2006.01)

(52) U.S. Cl. ..... 72/319; 72/384

(58) Field of Classification Search ..... 72/319–323, 72/312–315, 381–384
See application file for complete search history.

(56) References Cited

U.S. PATENT DOCUMENTS

| | | | | |
|---|---|---|---|---|
| RE31,938 | E | 7/1985 | Klukow | |
| 5,454,247 | A | 10/1995 | Powers et al. | |
| 5,454,261 | A * | 10/1995 | Campian | 72/384 |
| 5,970,774 | A | 10/1999 | Burgess et al. | |
| 6,128,811 | A | 10/2000 | Panzer et al. | |
| 2007/0033979 | A1 | 2/2007 | Deis et al. | |

FOREIGN PATENT DOCUMENTS

| | | |
|---|---|---|
| WO | WO 99/11398 | 3/1999 |

* cited by examiner

*Primary Examiner* — Dana Ross
*Assistant Examiner* — Matthew G Katcoff

(57) ABSTRACT

The present invention provides bending apparatuses and methods that can form lithographic plates having different radii, such as for different printing press configurations, without the need to remove and replace the anvils on a bending apparatus. More particularly, the present invention provides bending apparatuses having integrated changeable anvils useable for forming bends having different radii.

23 Claims, 18 Drawing Sheets

BENDING APPARATUS HAVING CHANGEABLE ANVILS AND RELATED METHODS

CROSS REFERENCE TO RELATED APPLICATIONS

The present application claims priority to U.S. Provisional Application No. 61/001,848 filed Nov. 5, 2007, the entire contents of which is incorporated herein by reference for all purposes.

TECHNICAL FIELD

The present invention relates generally to the processing of lithographic plates. More particularly, the present invention relates to equipment for bending lithographic plates for the purpose of mounting and securing such plates on a press plate cylinder.

BACKGROUND

A typical lithographic plate includes features such as flanges and openings that enable the plate to be mounted on a printing plate cylinder of a printing press. The configuration of these flanges and openings defines the alignment between plural plates installed on a printing press and provides the registration of the various colors of the printed image. Accordingly, precision metal working techniques for bending such flanges and forming such openings are used to ensure precision alignment between plural plates mounted on a printing press.

A typical machine used for forming a precision bend in a lithographic plate includes an anvil provided at the end of a supporting surface, a clamping device for clamping a plate to be bent to the supporting surface, and a mandrel for bending the plate around the anvil to form a flange. The anvil has an end with a forming surface that has a predetermined radius and a bend is made by rolling the plate around the radius of the forming surface of the anvil. In this way, the material of the plate conforms to the shape of the anvil to form a bend radius in the flange that is defined by the radius of the forming surface of the anvil. Exemplary machine tools for bending lithographic plates are described in U.S. Pat. No. Re. 31,938, reissued Jul. 9, 1985, to Klukow, U.S. Pat. No. 5,970,774 to Burgess et al., and U.S. Pat. No. 5,454,247 to Powers et al., the disclosures of which are incorporated herein by reference in their entirety for all purposes.

Lithographic plate bending machines, as presently known, suffer from certain limitations. Printing presses made by different manufactures have lithographic plate receiving slots that require lithographic plates with mounting flanges having angles and bend radiuses different than those of other manufacturers. This requires the printer to either have multiple benders each with an anvil having an angle and radius unique to the printing press on which the lithographic plate is to be mounted or to remove and replace the anvils each time a lithographic plate is to be bent for a different printing press.

SUMMARY

The present invention provides bending apparatuses and methods that can form lithographic plates having different radii, such as for different printing press configurations, without the need to remove and replace the anvils on a bending apparatus. More particularly, the present invention provides bending apparatuses having integrated changeable anvils useable for forming bends having different radii. An exemplary apparatus includes a first anvil having a first radius and one or more additional anvils having a different radius. An additional anvil can be moved between a home or retracted position and a working or bending position. When an additional anvil is positioned in the home position the first anvil is used for bending. When the additional anvil is positioned in the working position the additional anvil is used for bending.

Advantageously, apparatuses having one or more additional anvils allow bending of different radii with the same bending apparatus without significant reduction in cycle times. Moreover, bending apparatuses in accordance with the present invention allow fast changes between different radii without reduction of the cycle times, utilize competitive mechanics, can be built with standard assemblies without difficult adjustments, have unrestricted utilization of the current work widths per associated tool width, are expandable to three or more radii, are service-friendly, and are usable with pneumatic and/or electrical bending drives.

In an aspect of the present invention an apparatus for forming a mounting flange on a printing plate is provided. The apparatus comprises a bending device. The bending device comprises: a supporting bed having a working surface that can position and support a printing plate relative to the bending device; a first anvil comprising a first forming surface having a first radius, the first anvil positioned relative to the working surface of the supporting bed so a printing plate positioned on the working surface of the supporting bed can be bent around the forming surface of the first anvil to form a flange on the printing plate; a clamping device positioned relative to the working surface of the supporting bed, the clamping device having a clamping surface movable between a first unclamped position where the clamping surface is spaced apart from the working surface of the supporting bed and a second clamped positioned where the clamping surface can contact a printing plate positioned on the working surface of the supporting bed to hold the printing plated during a bending operation to form a flange on the printing plate; a mandrel positioned relative to the first forming surface of the first anvil, the mandrel having a body portion and a working surface capable of being controllably rotated about the first forming surface of the first anvil to form a flange on a printing plate when positioned on the working surface of the supporting bed and held by the clamping device; a second anvil comprising a second forming surface having a second radius different from the first radius of the first forming surface of the first anvil, the second anvil moveable relative to the first anvil between a first retracted position where the first anvil is used to form a flange on a printing plate and a second working position where the second anvil is used to form a flange on a printing plate; and a control system that controls operation of one or more of the clamping device, mandrel, and second anvil.

In another aspect of the present invention, the above described apparatus comprises a bank of plural anvils wherein each anvil of the bank of anvils comprises a forming surface having a radius distinct from the radiuses of the other anvils of the bank of anvils, each anvil of the bank of anvils moveable in a first direction relative to the first anvil between a first retracted position where the first anvil is used to form a flange on a printing plate and a second working position where each anvil is used to form a flange on a printing plate, each anvil of the bank of anvils moveable in a second direction generally orthogonal to the first direction to position each anvil relative to the first anvil and so each anvil can be positioned in the second working position.

In another aspect of the present invention an apparatus for forming a mounting flange on a printing plate is provided. The apparatus comprises a bending device. The bending device comprises: a supporting bed having a working surface that can position and support a printing plate relative to the bending device; a first anvil comprising a first forming surface having a first radius, the first anvil positioned relative to the working surface of the supporting bed so a printing plate positioned on the working surface of the supporting bed can be bent around the forming surface of the first anvil to form a flange on the printing plate; a clamping device positioned relative to the working surface of the supporting bed, the clamping device having a clamping surface movable between a first unclamped position where the clamping surface is spaced apart from the working surface of the supporting bed and a second clamped positioned where the clamping surface can contact a printing plate positioned on the working surface of the supporting bed to hold the printing plated during a bending operation to form a flange on the printing plate; a mandrel positioned relative to the first forming surface of the first anvil, the mandrel having a body portion and a working surface capable of being controllably rotated about the first forming surface of the first anvil to form a flange on a printing plate when positioned on the working surface of the supporting bed and held by the clamping device; an absorber device comprising at least one resilient portion operatively positioned between the working surface of the mandrel and a body portion of the mandrel wherein the resilience of the resilient portion can be controllably adjusted; a second anvil comprising a second forming surface having a second radius different from the first radius of the first forming surface, the second anvil moveable relative to the first anvil between a first retracted position where the first anvil is used to form a flange on a printing plate and a second working position where the second anvil is used to form a flange on a printing plate; and a control system that controls operation of one or more of the clamping device, mandrel, and second anvil.

In another aspect of the present invention, an apparatus for forming a mounting flange on a printing plate is provided. The apparatus comprises a bending device comprising: a supporting bed having a working surface that can position and support a printing plate relative to the bending device; a first moveable anvil comprising a first forming surface having a first radius, the first anvil moveable relative to the working surface of the supporting bed so the forming surface of the first anvil can be positioned relative to the working surface of the supporting bed so a printing plate positioned on the working surface of the supporting bed can be bent around the first radius of the first anvil to form a flange on the printing plate; a clamping device positioned relative to the working surface of the supporting bed, the clamping device having a clamping surface movable between a first unclamped position where the clamping surface is spaced apart from the working surface of the supporting bed and a second clamped positioned where the clamping surface can contact a printing plate positioned on the working surface of the supporting bed to hold the printing plated during a bending operation to form a flange on the printing plate; a mandrel positioned relative to the first forming surface of the first anvil, the mandrel having a body portion and a working surface capable of being controllably rotated about the first forming surface of the first anvil to form a flange on a printing plate when positioned on the working surface of the supporting bed and held by the clamping device; a second movable anvil comprising a second forming surface having a second radius different from the first radius of the first forming surface, the second anvil moveable relative to the working surface of the supporting bed between a first retracted position and a second working position where the second anvil is used to form a flange on a printing plate; and a control system that controls operation of one or more of the clamping device, mandrel, and second anvil.

In another aspect of the present invention, a method of forming a mounting flange on a printing plate is provided. The method comprises: providing any of the apparatuses described herein; positioning the clamping device in the first unclamped position; positioning a printing plate on the working surface of the supporting bed; positioning the clamping device in the second clamped position thereby clamping the printing plate to the working surface of the supporting bed; positioning the second anvil in the second working position of the second anvil wherein the second anvil is nested with the first anvil; and rotating the mandrel about the center of the first radius of the first anvil.

In another aspect of the present invention, an apparatus for forming a mounting flange on a printing plate is provided. The apparatus comprises a bending device. The bending device comprises a supporting bed; a first anvil comprising a first forming surface having a first radius; a clamp and mandrel positioned relative to the first forming surface of the first anvil, the mandrel capable of being controllably rotated about the first forming surface of the first anvil to bend a printing plate when positioned on the supporting surface; a second anvil comprising a second forming surface having a second radius, the second anvil moveable relative to the first anvil between a retracted and working position; and a control system.

In another aspect of the present invention a method of forming a mounting flange on a printing plate is provided. The method comprises: positioning a printing plate on a supporting surface relative to a first anvil and a clamp and mandrel of a bending device; moving second anvil from a retracted position to a working position; clamping the printing plate to the supporting surface; and rotating the mandrel about the second anvil.

In yet another aspect of the present invention, a method of changing anvils in a bending device is provided. The method comprises the steps of selecting one of plural anvils to use for a bending operation and moving the selected anvil from a retracted position to a working position.

BRIEF DESCRIPTION OF THE DRAWINGS

The accompanying drawings, which are incorporated in and constitute a part of this disclosure, illustrate several aspects of the present invention and together with description of the exemplary embodiments serve to explain the principles of the invention. A brief description of the drawings is as follows.

DETAILED DESCRIPTION

Figure 1:
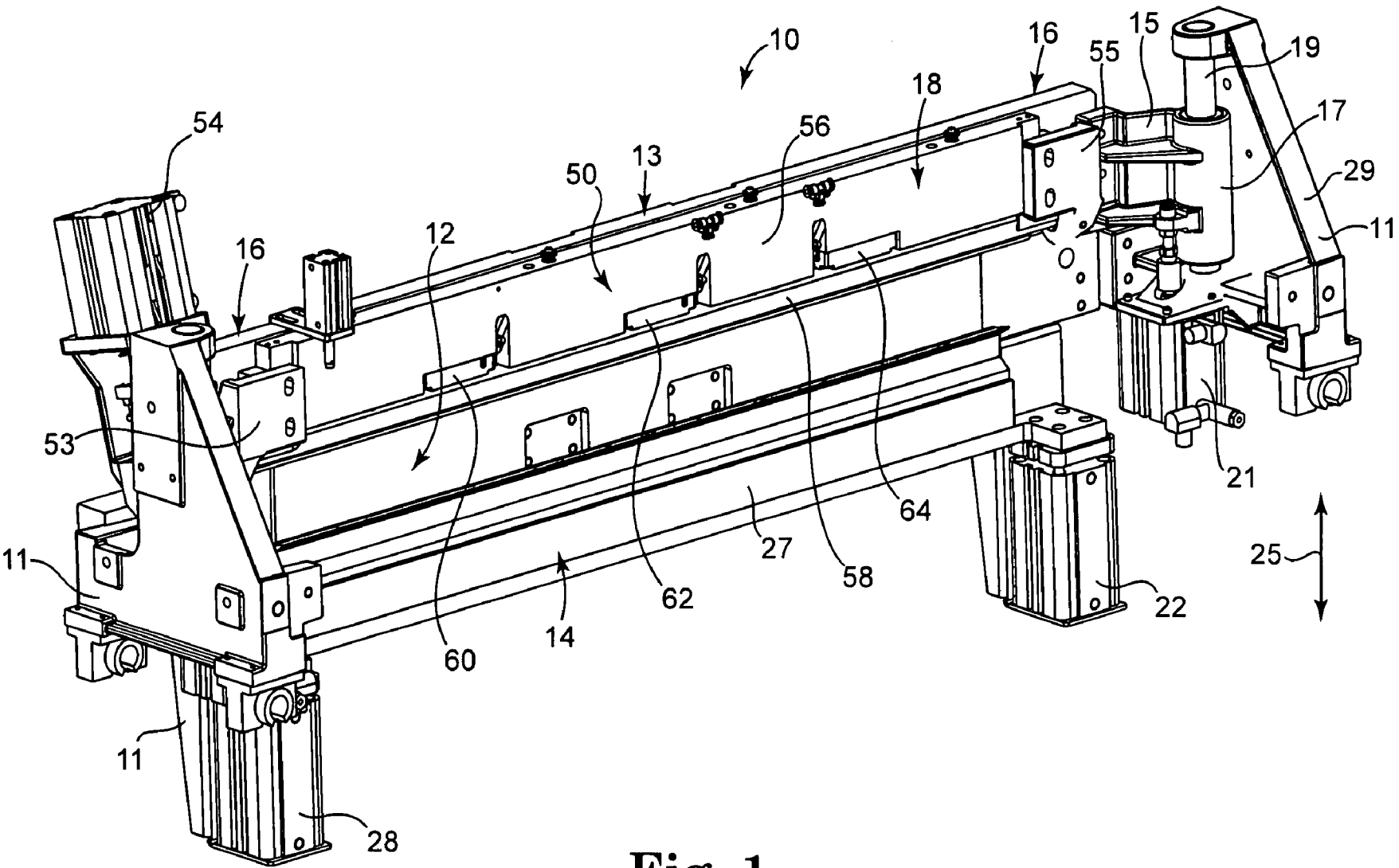
FIG. 1 is a perspective view of an exemplary bending apparatus 10 in accordance with the present invention showing a first stationary anvil, second moveable anvil, rotatable mandrel, and a clamping device.
Figure 2:
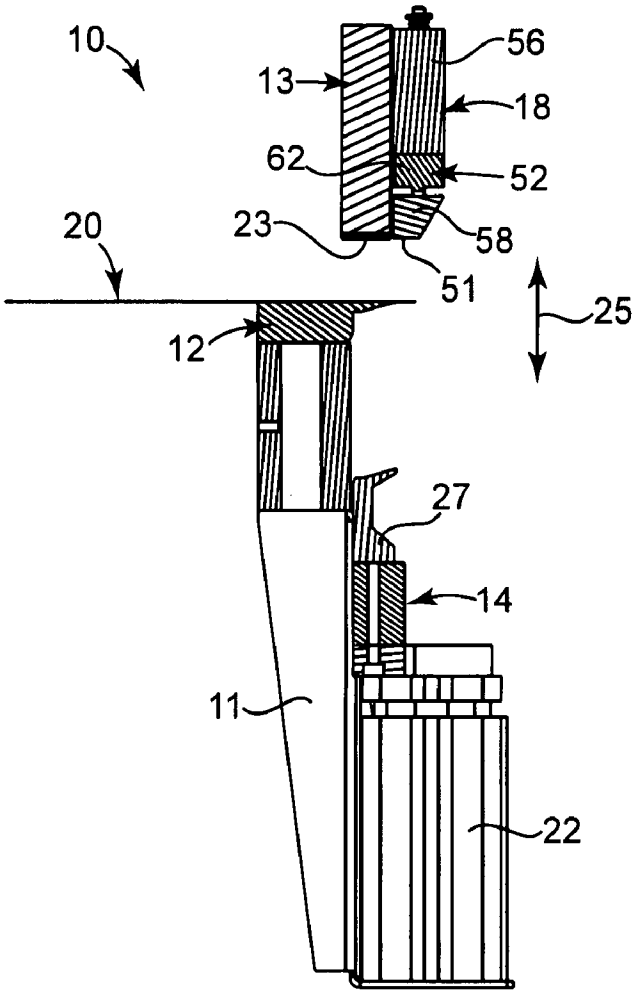
FIG. 2 is a cross-sectional schematic view of the bending apparatus of FIG. 1 showing a printing plate to be bent by the bending apparatus and the second anvil, mandrel, and clamping device each in a retracted position.

Referring to FIGS. 1 and 2 initially, a perspective view of bending apparatus 10 is shown in FIG. 1 and a schematic cross-sectional view of bending apparatus 10 is shown in FIG. 2. Bending apparatus 10 can be used with a bending system (not shown) wherein plural bending apparatuses are used such as at opposite ends of a bending system. Generally, bending apparatus 10 includes first anvil 12, second movable anvil 14, clamping device 16, and mandrel 18, operatively integrated with and supported by machine frame 11.

In the schematic view of FIG. 2 second anvil 14, clamping device 16, and mandrel 18 are each shown in a retracted position. As shown, first anvil 12 comprises a supporting bed having a support or working surface that supports printing plate 20 during a bending process to form a flange on printing plate 20 and a forming surface having a first predetermined radius for forming a bend having such radius and at a predetermined angle in plate 20 cooperatively with clamping device 16 and mandrel 18. The support surface portion of first anvil 12 can be integrated with first anvil 12, as illustrated, or can be a distinct structural element of bending apparatus 10. An additional supporting bed having a supporting surface can be provided adjacent to first anvil 12 if desired such as part of a larger bending system that uses plural bending apparatuses at opposite ends of the system.

First anvil 12 is preferably static (not moveable) and designed to be operatively integrated with machine frame 11 as can be seen schematically in FIG. 2. First anvil 12, however, can be designed to be moveable relative to any of second moveable anvil 14, clamping device 16, and mandrel 18, if desired. For example, first anvil 12 (or a portion thereof) may be designed to move out of the way of second anvil 14 when second anvil 14 is moved to a working position for forming a flange on a printing plate.

Clamping device 16 is designed to clamp or hold printing plate 20 against the support surface, such as can be provided by first anvil 12, and relative to the forming surface of first anvil 12 while mandrel 18 is rotated about the radius of the forming surface of the first anvil 12 to provide a flange on printing plate 20. As illustrated, clamping device 16 comprises clamping bar 13 that extends across bending apparatus 10. Clamping bar 13 includes clamping surface 23, which may comprise a pad of a resilient material such as rubber or plastic or the like. Clamping bar 13 is attached to bracket 15 having bearing 17. Bearing 17 rides on linear rod 19 as operatively connected to machine frame portion 29. A similar bearing and linear rod (and actuator) are used on the opposite side of clamping bar 13 and not readily visible in the Figures. Linear actuator 21 is operatively attached to bracket 15 and functions to move bracket 15 along linear rod 19, which moves clamping device 16 between clamped and unclamped positions in machine direction indicated by reference numeral 25. As shown, linear actuator 21 comprises a pneumatically actuated drive device. Linear actuator 21, however, may comprise any device or mechanism capable of providing linear motion.

Second anvil 14 comprises a forming surface having a second predetermined radius for forming a bend having such radius in plate 20 cooperatively with clamping device 16 and mandrel 18. The angle of the bend is related to the degree of rotation of mandrel 18. The radius of second anvil 14 is different from the radius of first anvil 12 thus allowing bending apparatus 10 to form a flange on printing plate 20 having a bend radius different from that which can be formed using first anvil 12. In an exemplary preferred embodiment, the radius of the forming surface of the second anvil 14 is larger than the radius of the forming surface of the first anvil 12. The first and second anvils, 12 and 14, can be designed, however, so the radius of the forming surface of the second anvil 14 is smaller than the radius of the forming surface of the first anvil 12.

Figure 9:
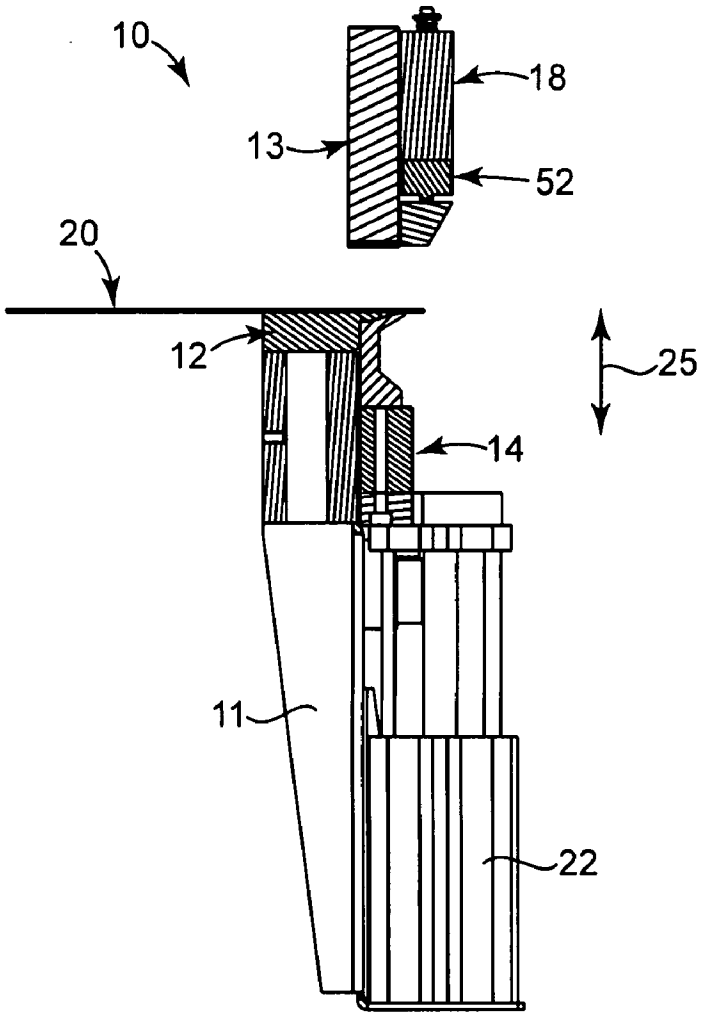
FIG. 9 is a cross-sectional schematic view of the bending apparatus of FIG. 1 showing a printing plate to be bent by the bending apparatus and the second anvil in a working position nested with the first anvil and the mandrel and clamping device each in a retracted position.

Second anvil 14 is designed to be moveable relative to first anvil 12 along machine direction indicated by reference numeral 25 as can be seen schematically in FIG. 2. Moving second anvil 14 relative to first anvil 12 allows second anvil 14 to be moved between a retracted non-functional position, as shown in FIG. 2 and a working functional position as shown in FIG. 9. Second anvil 14 is preferably designed so that when in the working position, second anvil cooperatively nests with first anvil 12 and is positioned in a functional position relative to clamping device 16 and mandrel 18. As used herein the term nesting refers to the relative position of the first and second anvils, 12 and 14. Preferably, first and second anvils, 12 and 14, are designed to fit compactly together when second anvil 14 is positioned in the working position. That is, first and second anvils, 12 and 14, are preferably designed so that adjacent surfaces of first and second anvils, 12 and 14, closely follow or mirror each other when second anvil 14 is positioned in the working position.

As shown, second anvil 14 comprises bar 27 operatively connected to first and second linear actuators, 22 and 28, respectively, at opposite ends of bar 27. Linear actuators 22 and 28 are operatively connected to machine frame 11 of bending device 10. As shown, linear actuators 22 and 28, comprises pneumatically actuated drive devices. Linear actuators 22 and 28, however, may comprise any device or mechanisms capable of providing linear motion such as those that use mechanical, electrical, pneumatic, and hydraulic motion or combinations thereof.

Mandrel 18 comprises body 50 and absorber device 52. Body 50 is operatively connected to first and second brackets, 53 and 55, at opposite ends of body 50 as shown. Body 50 includes contacting surface 51, which may comprise a pad of a resilient material such as rubber or plastic or the like. Brackets 53 and 55 are pivotably connected to machine frame 11 of bending apparatus 10 at pivot points. The pivot points are positioned at the center of the first radius of the first anvil 12 so that mandrel 18 rotates about the radius of the first anvil 12 when forming a bend in printing plate 20. As shown, mandrel 18 is operatively connected to actuator 54, which is operatively connected to machine frame 11 of bending device 10. Mandrel 18 includes rack and pinion device (not visible in Figures) that provides linear motion for mandrel 18 and pivots for providing rotational motion of mandrel 18. Preferably, mandrel 18 is designed to move linearly together with clamping device 16. As shown, actuator 54 comprises a pneumatically actuated drive device. Actuator 54, however, may comprise any device or mechanism capable of providing the desired motion.

Figure 28:
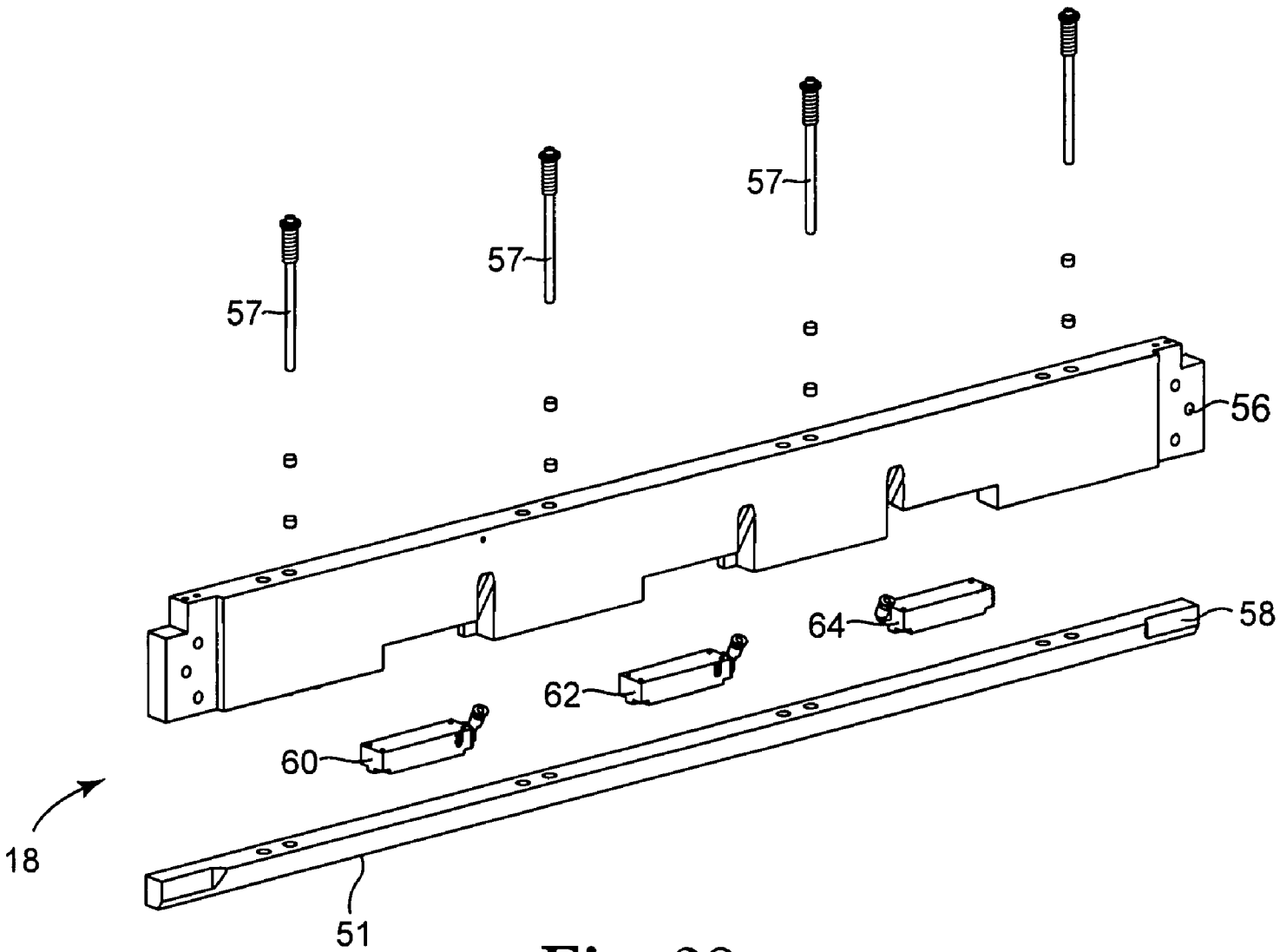
FIG. 28 is an exploded perspective view of a mandrel comprising an exemplary absorber device including plural pneumatic bladders.

Mandrel 18 is shown in more detail in FIG. 28 as an exploded view. As shown, absorber device 52 of mandrel 18 preferably includes resilient bladders 60, 62, and 64 operatively positioned between first portion 56 of body 50 of mandrel 18, which contacts printing plate 20 during bending and second portion 58 of body 50 of mandrel 18, which is attached to, brackets 53 and 55. First and second portions, 56 and 58 are assembled using bolts 57, as shown. Any desired technique and structure can be used to assemble first and second portions, 56 and 58, respectively, and bladders 60, 62, and 64 to form mandrel 18 as long as second portion 58 is movable relative to first portion 56 as controllable by absorber device 52.

Preferably, as shown, bladders 60, 62, and 64 are spaced apart across mandrel 18 and any desired number of bladders or resilient devices can be used. Bladders 60, 62, and 64 function to provide resilience between first and second portions, 56 and 58, respectively, of body 50 of mandrel 18 when second anvil 14 is used to form a flange on printing plate 20. First and second portions, 56 and 58, respectively, also allow second portion 58 to be moved relative to first portion 56.

When second anvil 14 is nested with first anvil 12 in the working position of second anvil 14 the center of the radius of the forming surface of second anvil is spaced apart from the center of the radius of the forming surface of the first anvil 12. Because mandrel 18 pivots about the center of the radius of the forming surface of the first anvil 12, resilience provided by bladders 60, 62, and 64 has been found to help allow mandrel 18 to rotate and form consistent bends having the desired bend radius and flange angle.

Additionally, absorber device 52 is preferably designed to allow first and second portions, 56 and 58, respectively, of body 50 to be controllably moved relative to each other. That is, after forming a bend on printing plate 20, second portion 58 can be retracted away from printing plate 20 so that contacting surface 51 of second portion 58 is spaced apart from printing plate 20 during the return stroke of mandrel 18. If absorber device 52 comprises pneumatic bladders as illustrated in the exemplary embodiment, for example, the bladders are preferably inflated during a bending stroke of mandrel 18 and at least partially deflated during the return stroke of mandrel 18. When inflated, however, such inflation is preferably enough to functionally bend printing plate 20 and still provide any desired resilience during the bending stroke. That is, resilience is preferably increased during such bending step, and is particularly useful when bending using second anvil 14. Deflation of the bladders during the return stroke helps to prevent possible undesirable pressure from being placed on printing plate 20 during the return stroke after the flange has been formed, which pressure could undesirably change the shape of the formed flange.

Bladders 60, 62, and 64, as shown, each comprises a pneumatic device that can be pressurized and depressurized as desired when forming a bend and are particularly useful when forming a bend using second anvil 14 because mandrel 18 rotates about the center of the first radius of the first forming surface of the first anvil 12, which is not coincident with the second radius of the second forming surface of the second anvil 14. Any device or mechanism or the like capable of providing resilience between first and second portions, 56 and 58, of body 50 of mandrel can be used. For example, springs or other mechanical devices capable of providing resilience, as well as hydraulic devices such as cylinders and pistons, and resilient material such as foam and rubber or the like can be used. An exemplary pneumatic device that can be used for bladders 60, 62, and 64 comprises a short stroke pneumatic cylinder available from Festo Corporation as part number EV-15/63-4.

Bending device 10 also preferably include a control system (not shown). The control system preferably includes a computer having of a central processing unit, memory, and a user interface. The user interface may include, for example, a keyboard or other type of control panel as well as a monitor or display and a printer. The computer, along with other components of the control system, controls the operation of the components of bending apparatus 10.

In general, first anvil 12, clamping device 16, and mandrel 18 can be designed according to known bending apparatuses. That is, bending devices that use a single anvil, clamp, and mandrel are well known. For example, such bending devices are described in U.S. Pat. No. Re. 31,938, reissued Jul. 9, 1985, to Klukow, U.S. Pat. No. 5,970,774 to Burgess et al., and U.S. Pat. No. 5,454,247 to Powers et al. the disclosures of which are each fully incorporated by reference herein for all purposes.

Referring now to FIG. 2 in particular, bending apparatus 10 is schematically shown with plate 20 positioned for a bending operation using first anvil 12 with first radius. Clamping device 16 and mandrel 18 are each in a retracted position relative to plate 20 and first anvil 12. Second anvil 14 is in a retracted (home) position relative to first anvil 12. Second anvil 14 may be partially or fully retracted.

Figure 3:
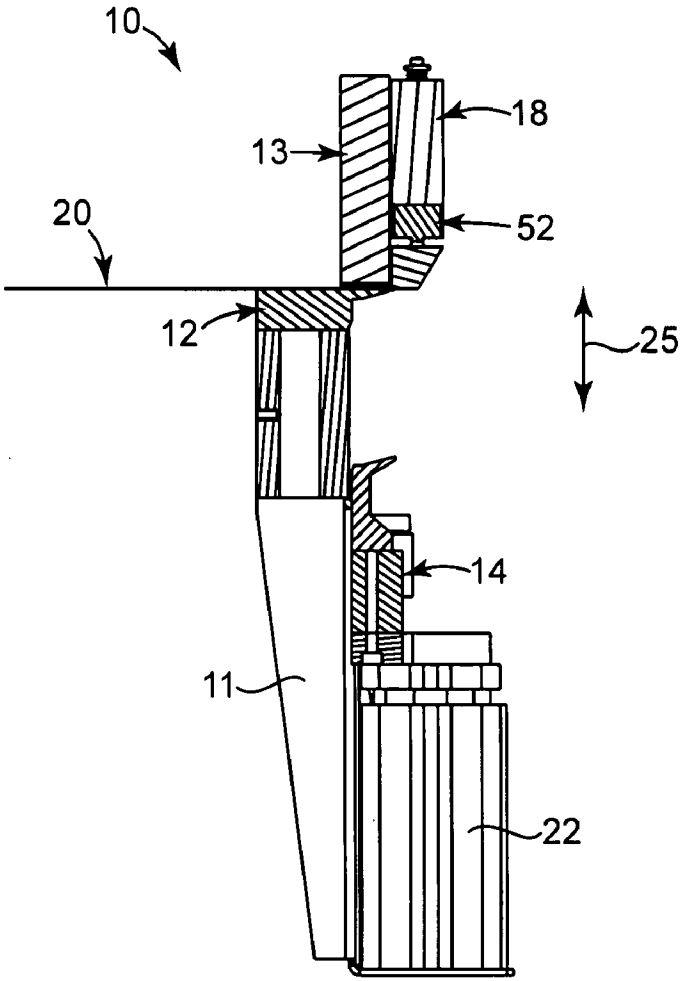
FIG. 3 is a cross-sectional schematic view of the bending apparatus of FIG. 1 showing the second anvil in a retracted position, the mandrel in a position ready to form a bend in the printing plate, and the clamping device in a clamped position.
Figure 5:
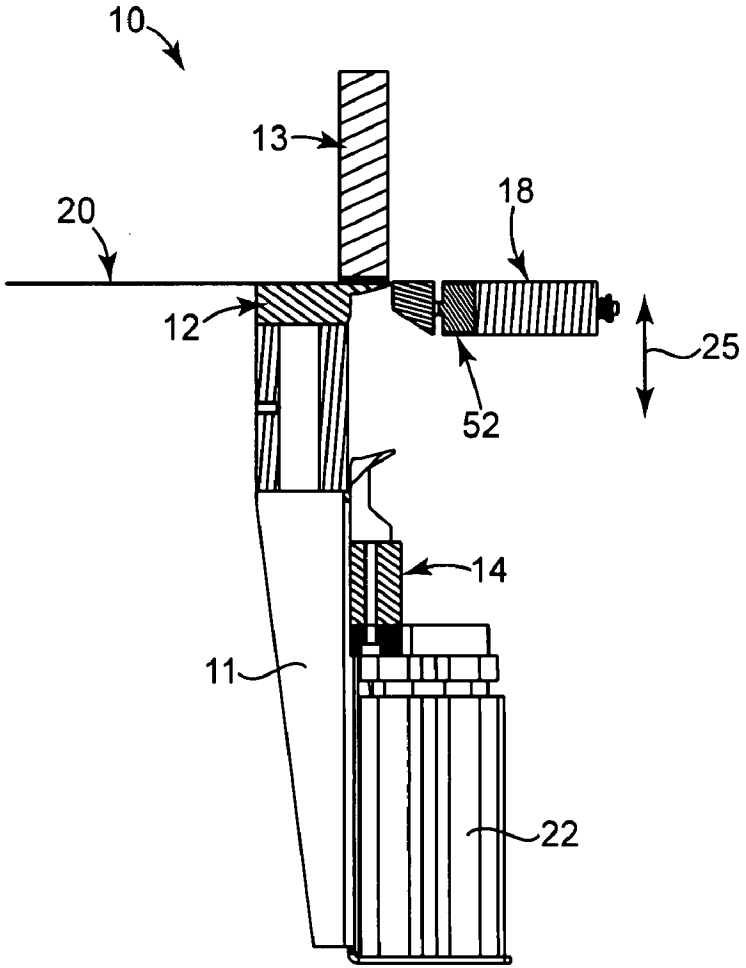
FIG. 5 is a cross-sectional schematic view of the bending apparatus of FIG. 1 showing the second anvil in a retracted position, the mandrel further partially rotated around the forming surface of the first anvil as compared to FIG. 4, and the clamping device in a clamped position.
Figure 4:
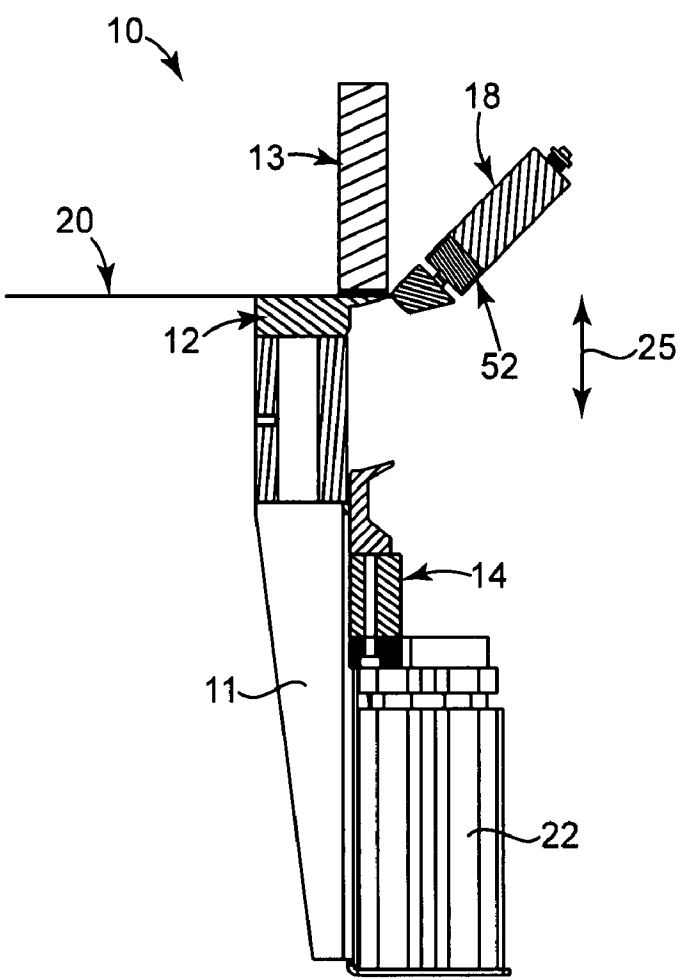
FIG. 4 is a cross-sectional schematic view of the bending apparatus of FIG. 1 showing the second anvil in a retracted position, the mandrel partially rotated around a forming surface of the first anvil, and the clamping device in a clamped position.

In FIG. 3 clamping device 16 is shown in the clamped position and mandrel 18 is in a position ready for bending plate 20 as clamped between first anvil 12 and clamping device 16. Second anvil 14 is in the retracted (home) position relative to first anvil 12. Resilient device 52 is preferably in an extended or inflated position. FIGS. 4 and 5 show incremental steps of the bending operation.

Figure 7:
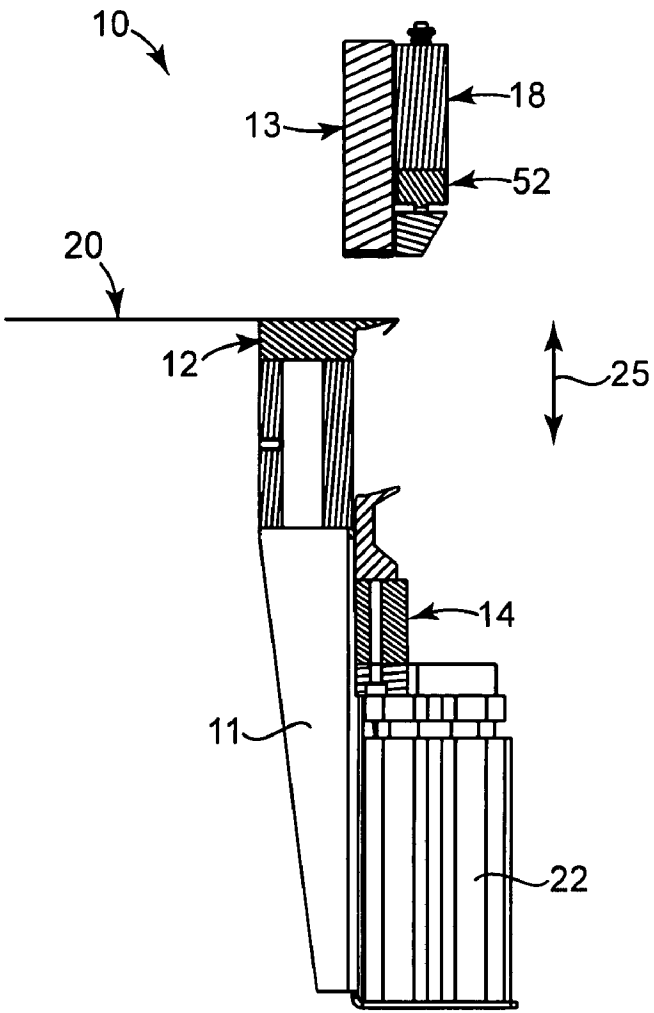
FIG. 7 is a cross-sectional schematic view of the bending apparatus of FIG. 1 showing a flange formed on the printing plate and the second anvil, mandrel, and clamping device each in a retracted position after forming the flange on the printing plate.
Figure 6:
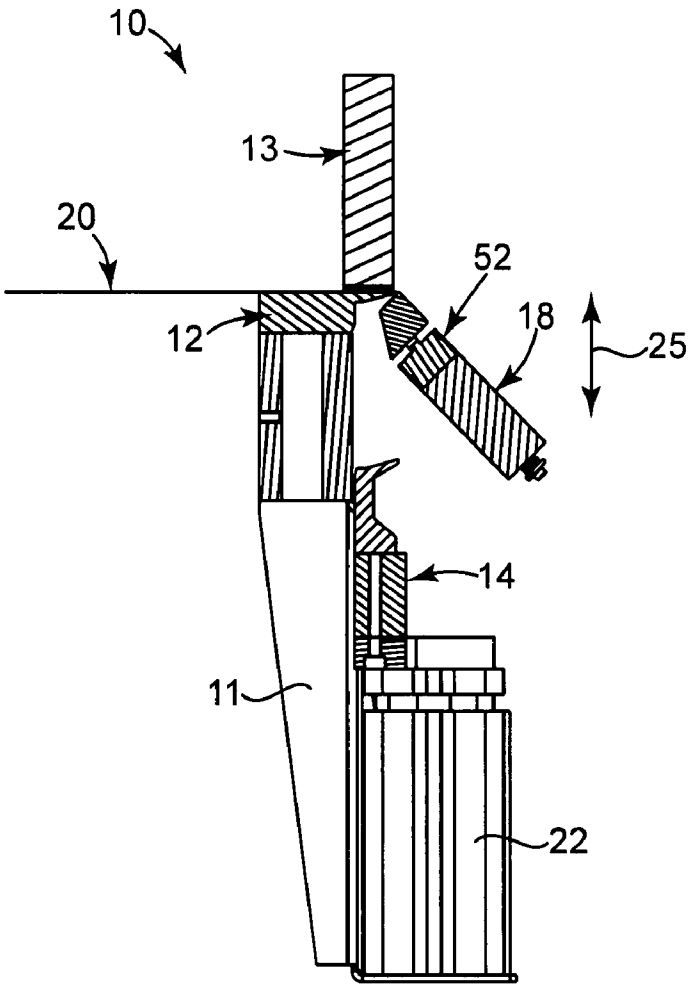
FIG. 6 is a cross-sectional schematic view of the bending apparatus of FIG. 1 showing the second anvil in a retracted position, the mandrel fully rotated around the forming surface of the first anvil to a desired bend angle, and the clamping device in a clamped position.
Figure 8:
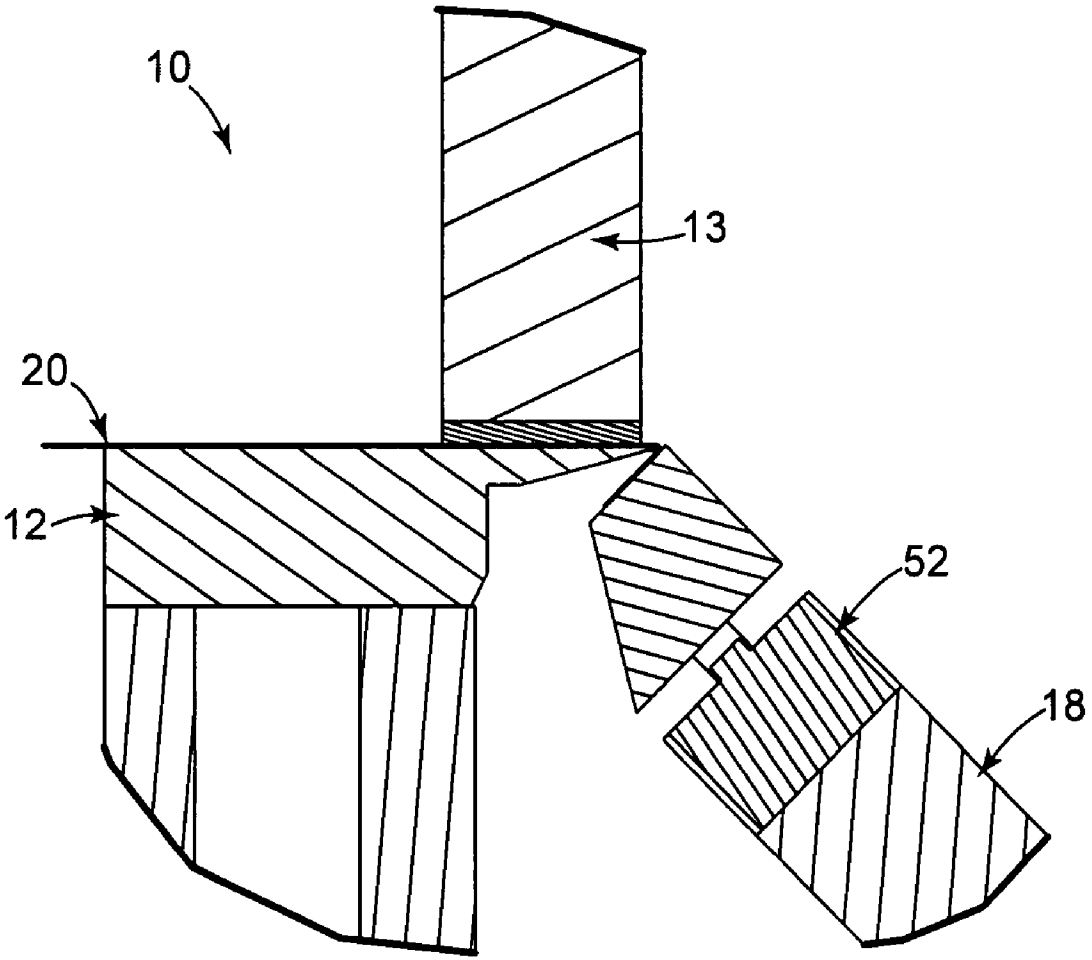
FIG. 8 is a detail view of the printing apparatus as shown in FIG. 8 at the completion of forming the flange on the printing plate.

In FIG. 6 mandrel 18 is shown rotated around the radius of first anvil 12 and at the end of a bending motion and showing a flange formed on plate 20. A detail view of plate 20, clamping device 16, mandrel 18, and first anvil 12 at the end of the bending motion of mandrel 18 is shown in FIG. 8. In FIG. 7 clamping device 16 and mandrel 18 are shown in the retracted position after the completed bend.

In FIG. 9 apparatus 10 is shown with plate 20 positioned for a bending operation using second anvil 14 having second radius different from first radius of first anvil 12. Preferably, the second radius is larger than the first radius. Clamping device 16 and mandrel 18 are in a retracted position relative to plate 20, first anvil 12, and second anvil 14. Second anvil 14 is in the functional working position relative to first anvil 12. In the working position, second anvil 14 is preferably nested with first anvil 12. In the illustrated exemplary apparatus 10, second anvil 14 is moveable between the retracted and working positions along a linear path indicated by machine direction identified by reference numeral 25 and as moved by linear actuator 22. Second anvil 14 can be designed to be move between the retracted and working positions along any desired path such as an arcuate, elliptical, and/or rotational path.

Figure 10:
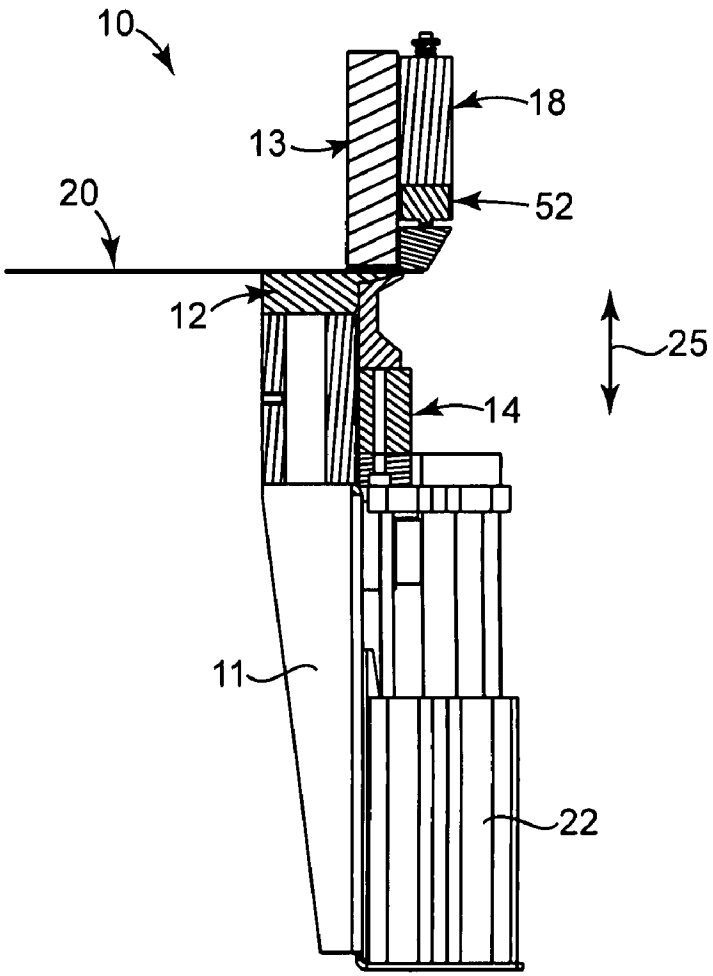
FIG. 10 is a cross-sectional schematic view of the bending apparatus of FIG. 1 showing the second anvil in the working position, the mandrel in a position ready to form a bend in the printing plate, and the clamping device in a clamped position.
Figure 12:
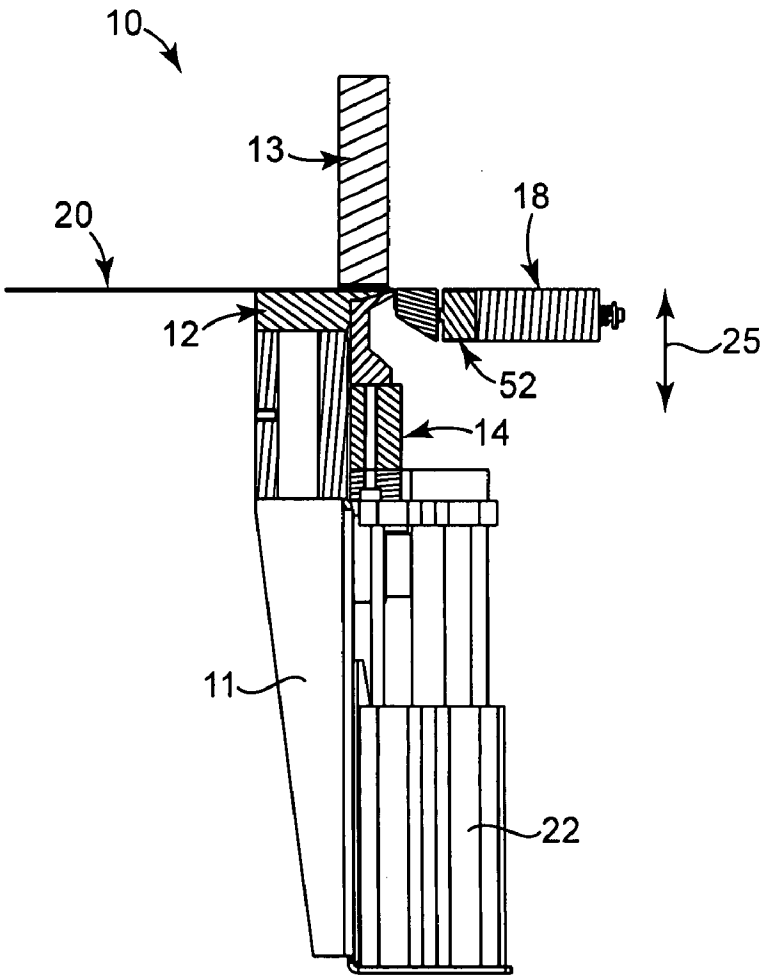
FIG. 12 is a cross-sectional schematic view of the bending apparatus of FIG. 1 showing the second anvil in the working position, the mandrel further partially rotated around the forming surface of the first anvil as compared to FIG. 11, and the clamping device in a clamped position.
Figure 11:
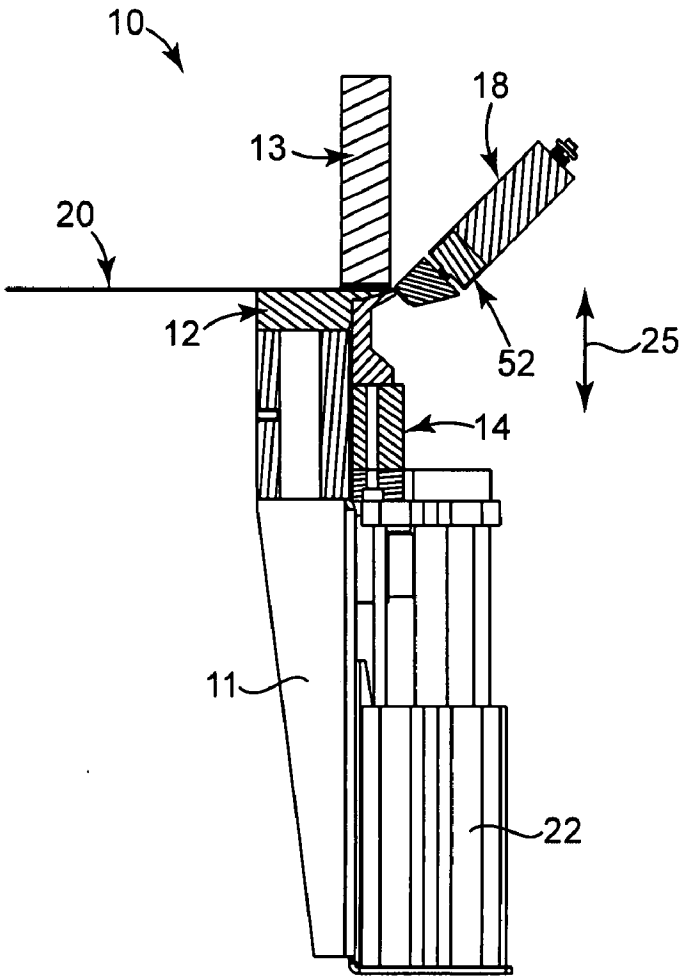
FIG. 11 is a cross-sectional schematic view of the bending apparatus of FIG. 1 showing the second anvil in the working position, the mandrel partially rotated around a forming surface of the second anvil, and the clamping device in a clamped position.

In FIG. 10 clamping device 16 is closed and mandrel 18 is in a position ready for bending plate 20 as clamped between first anvil 12 and clamping device 16. FIGS. 11 and 12 show incremental steps of the bending operation.

Figure 14:
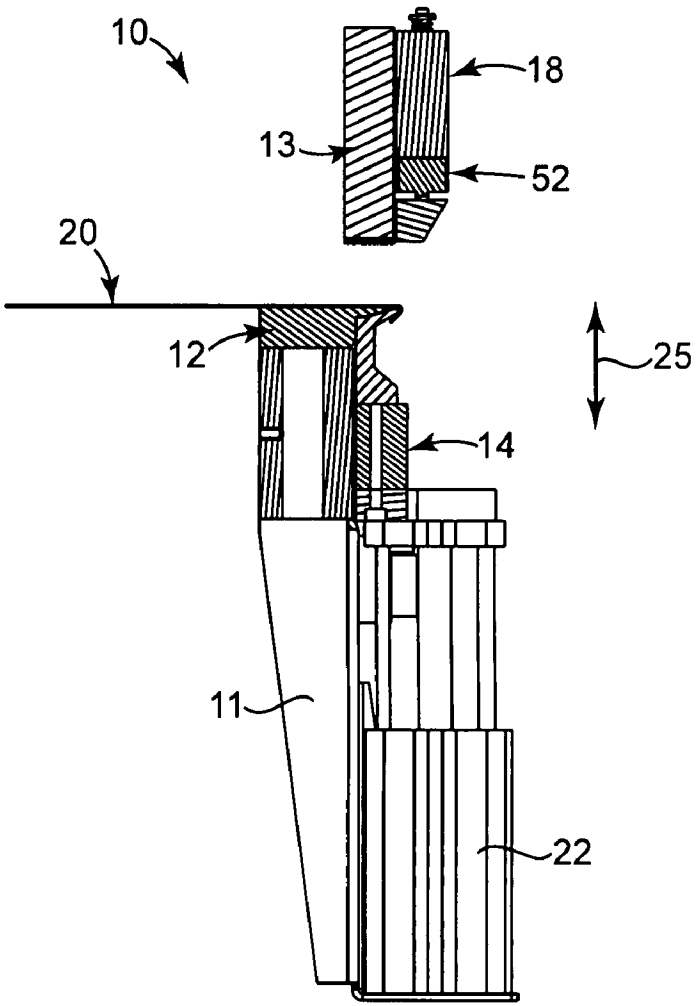
FIG. 14 is a cross-sectional schematic view of the bending apparatus of FIG. 1 showing a flange formed on the printing plate and the second anvil in the working position and the mandrel and clamping device each in a retracted position after forming the flange on the printing plate.
Figure 13:
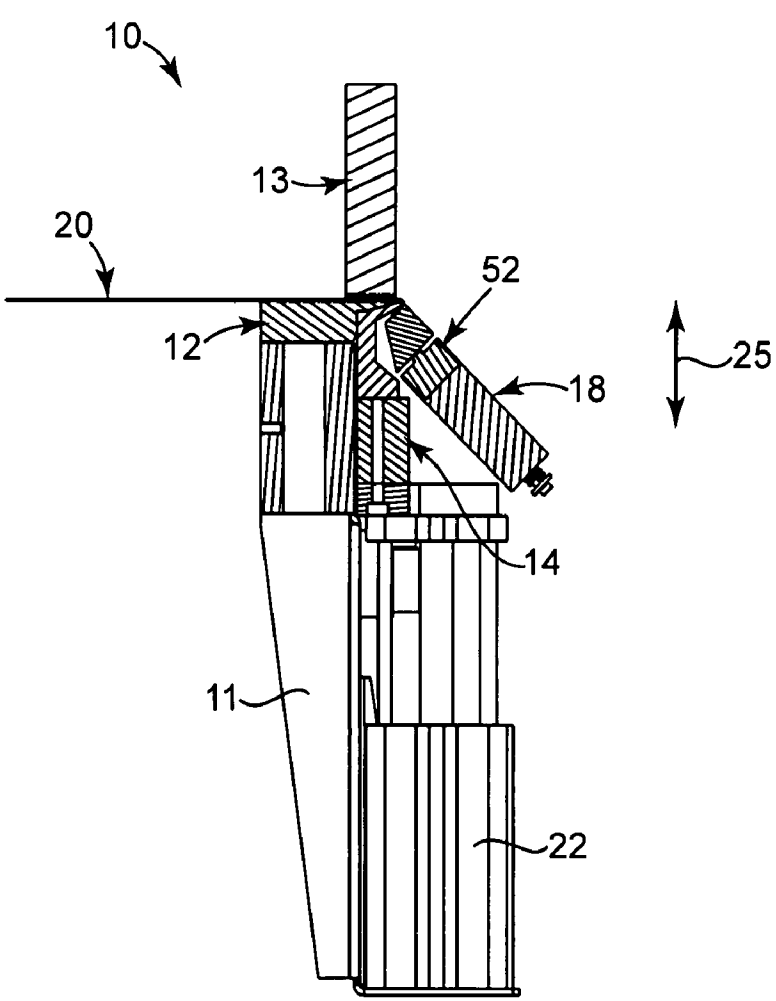
FIG. 13 is a cross-sectional schematic view of the bending apparatus of FIG. 1 showing the second anvil in the working position, the mandrel fully rotated around the forming surface of the second anvil to a desired bend angle, and the clamping device in a clamped position.
Figure 15:
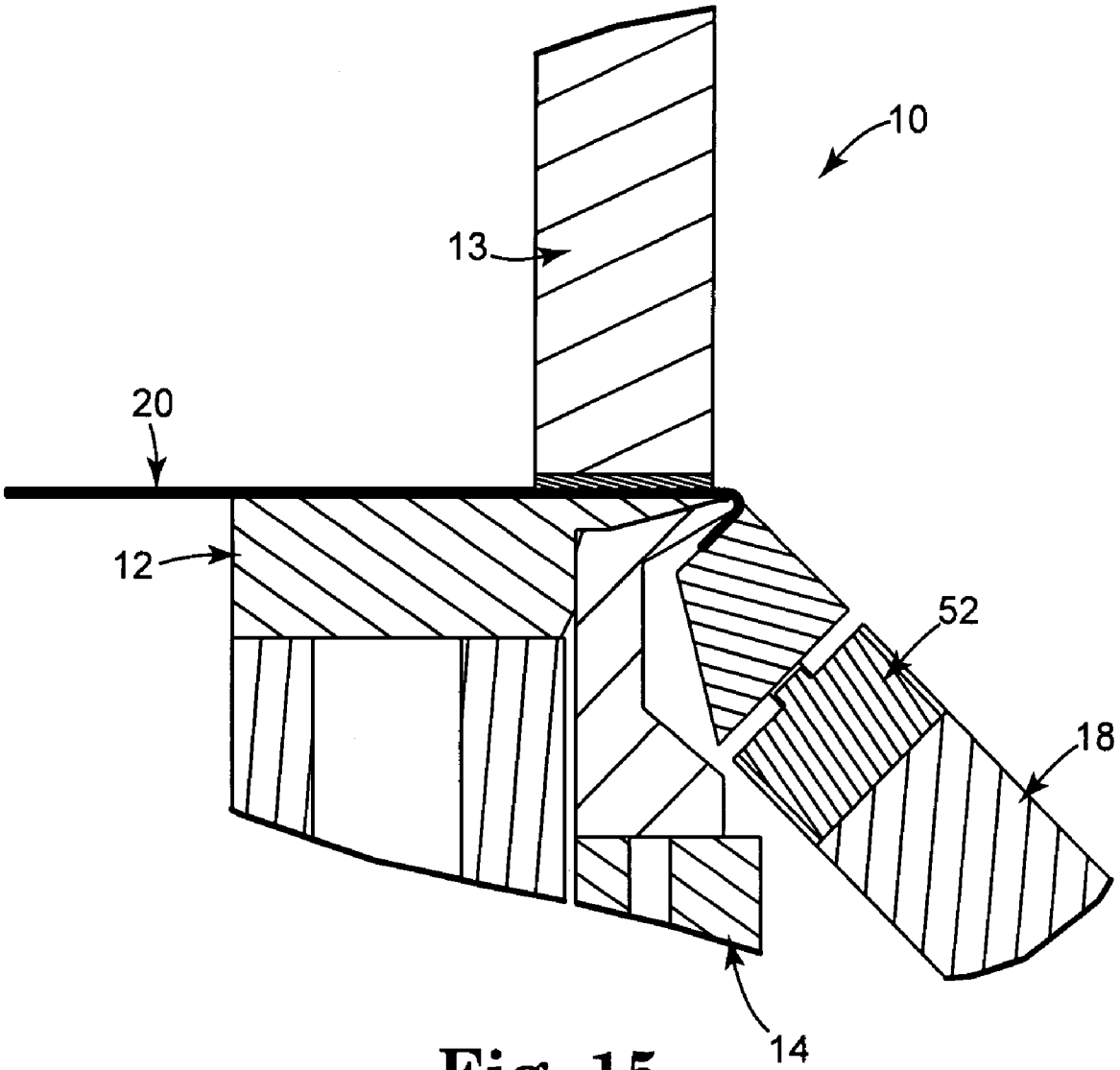
FIG. 15 is a detail view of the printing apparatus as shown in FIG. 13 at the completion of forming the flange on the printing plate.

In FIG. 13 mandrel 18 is shown rotated around pivot points corresponding with the center of the radius of first anvil 12 by and at the end of a bending motion and showing a flange formed on plate 20. When rotated, absorber device is configured to provide any desired level of resilience. A detail view of plate 20, clamping device 16, mandrel 18, and second anvil 14 at the end of the bending motion of the mandrel 18 is shown in FIG. 15. In FIG. 14 clamping device 16 and mandrel 18 are shown in the retracted position after the completed bend.

FIGS. 16-27 show another exemplary bending apparatus 30 in accordance with the present invention that includes a bank of plural movable anvils. FIGS. 16-21 are cross-sectional views of apparatus 30 illustrating structural elements of apparatus 30 and illustrating an exemplary bending process using a first anvil 34 nested with a supporting bed 32 and with a second anvil 36 in a retracted position in accordance with the present invention. FIGS. 22-27 are cross-sectional views of apparatus 30 illustrating an exemplary bending process using the second anvil 36 with the second anvil 36 in a working position and nested with the supporting bed 32 in accordance with the present invention.

Generally apparatus 30 is similar to apparatus 10 described above and includes supporting bed 32, first movable anvil 34, second movable anvil 36, clamping device 38, mandrel 40, and a control system (not shown). In the illustrated exemplary embodiment, first and second anvils, 34 and 36, respectively, provide a moveable bank of anvils in which any desired number of anvils can be used. Supporting bed 32, in the illustrated embodiment, is not used for forming a bend in a printing plate cooperatively with clamping device 38 and mandrel 40 but may include a forming surface having a radius for forming a bend if desired. For example, supporting bed 32 can be designed to function as an anvil as is described above with respect to apparatus 10. If supporting bed 32 is designed to function as an anvil, mandrel 40 is preferably designed to include and absorber device such is described above with respect to mandrel 18.

Supporting bed 32 is preferably static (not moveable) but can be designed to be moveable relative to any of first moveable anvil 34, second moveable anvil 36, clamping device 38, and mandrel 40. For example, supporting bed 32 (or a portion thereof) may be designed to move out of the way of first anvil 34 or second anvil 36 when such anvil is moved to a working position. Supporting bed 32, clamping device 38, and mandrel 40 can be designed according to known bending apparatuses and as described above. In particular, mandrel 40 may be designed to include an absorber device capable of providing resilience during a bending operation as described above with respect to absorber device 52 of mandrel 18.

Figure 16:
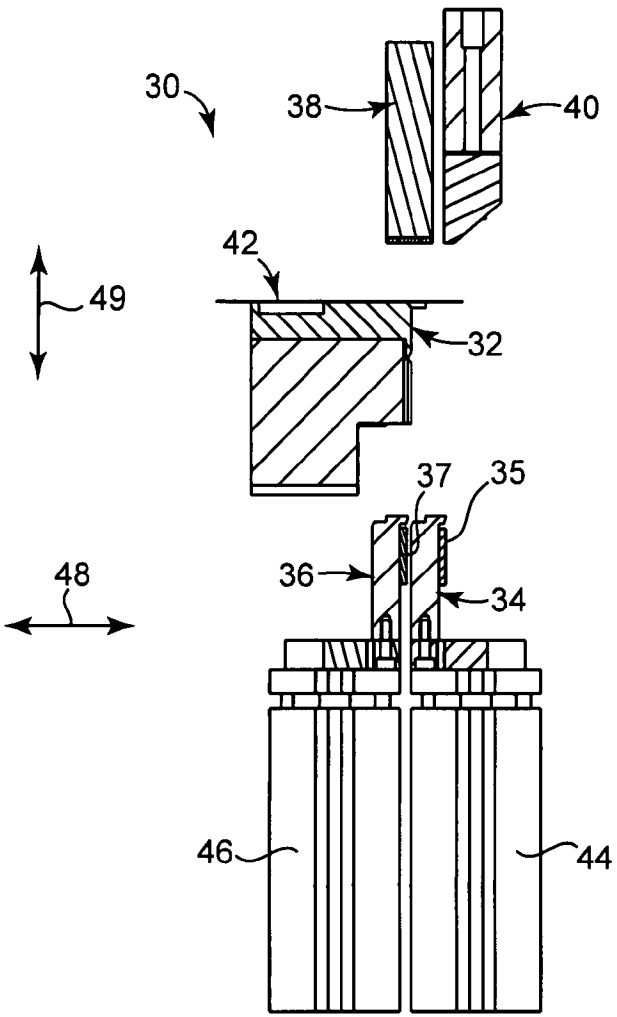
FIG. 16 is a cross-sectional schematic view of another exemplary bending apparatus in accordance with the present invention showing a printing plate to be bent by the bending apparatus and first and second moveable anvils, a mandrel, and a clamping device each in a retracted position.

In FIG. 16 apparatus 30 is shown with plate 42 positioned for a bending operation using first anvil 34 having a forming surface having a first radius. Clamping device 38 and mandrel 40 are in a retracted position relative to plate 42 and supporting bed 32. First anvil 34 and second anvil 36 are each in a retracted position relative to supporting bed 32. First anvil 34 and second anvil 36 may be partially or fully retracted.

Figure 17:
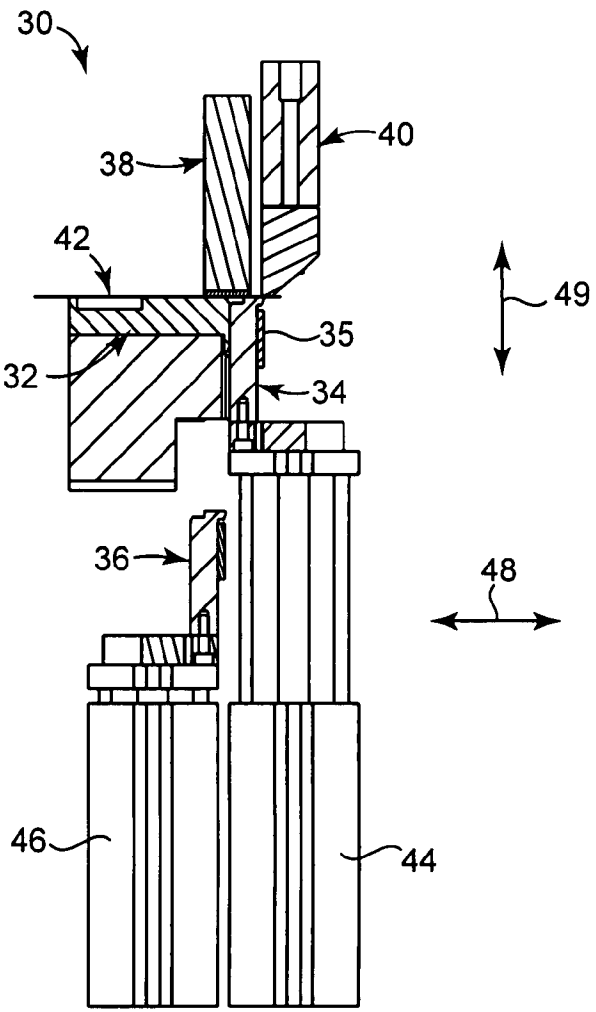
FIG. 17 is a cross-sectional schematic view of the bending apparatus of FIG. 16 showing the first anvil in a working position, the second anvil in a retracted position, the mandrel in a position ready to form a bend in the printing plate, and the clamping device in a clamped position.
Figure 19:
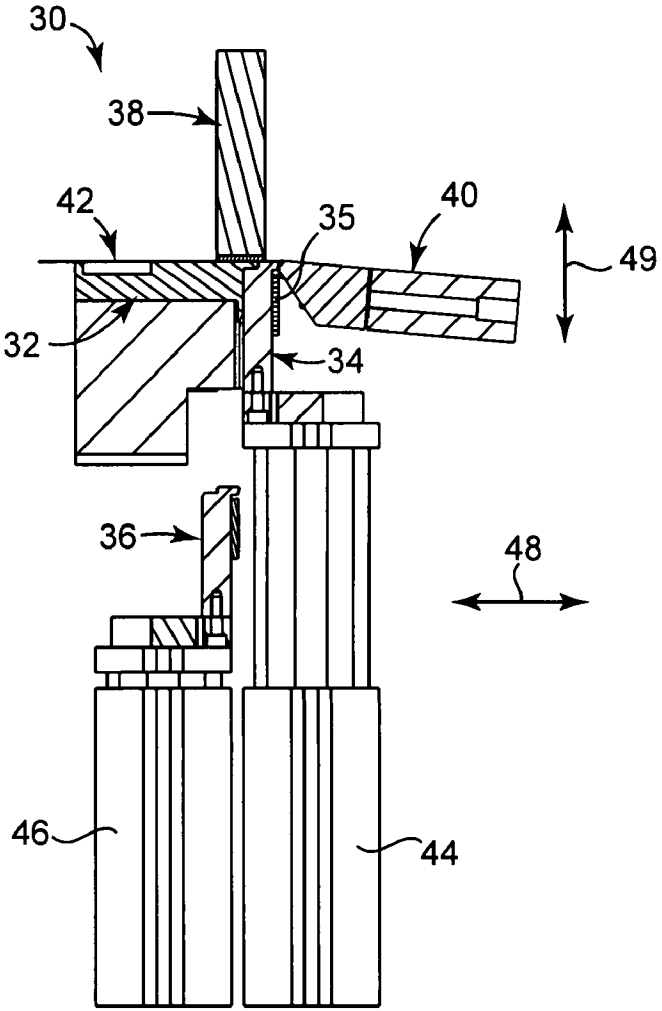
FIG. 19 is a cross-sectional schematic view of the bending apparatus of FIG. 16 showing the first anvil in a working position, the second anvil in a retracted position, the mandrel fully rotated around the forming surface of the second anvil to a desired bend angle, and the clamping device in a clamped position.
Figure 18:
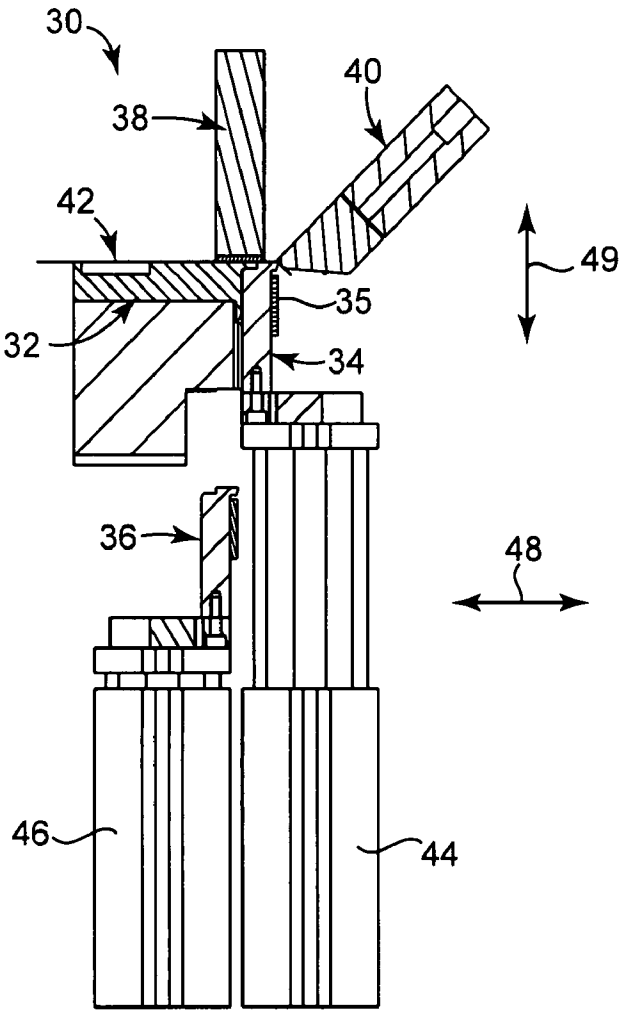
FIG. 18 is a cross-sectional schematic view of the bending apparatus of FIG. 16 showing the first anvil in a working position, the second anvil in a retracted position, the mandrel partially rotated around a forming surface of the first anvil, and the clamping device in a clamped position.

In FIG. 17 clamping device 38 is shown in the closed position and mandrel 40 is in a position ready for bending plate 42 as clamped between supporting bed 32 and clamping device 38. First anvil 34 is in a working position relative to supporting bed 32. In the working position, first anvil 34 is preferably nested with supporting bed 32, as shown. In the illustrated exemplary apparatus 30, first anvil 34 is moveable between the retracted and working positions along a linear path indicated by a machine direction identified by reference numeral 49 and as moved by linear actuator 44. First anvil 34 can be designed to be moved between the retracted and working positions along an arcuate, elliptical, and/or rotational path. FIGS. 18 and 19 show incremental steps of the bending operation.

Figure 21:
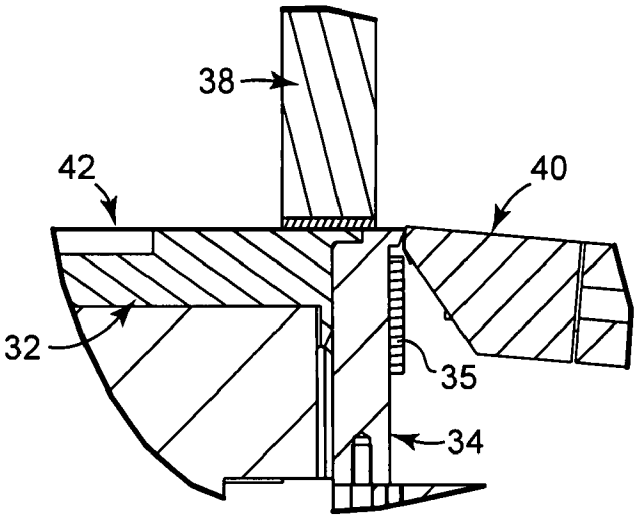
FIG. 21 is a detail view of the printing apparatus as shown in FIG. 19 at the completion of forming the flange on the printing plate.
Figure 20:
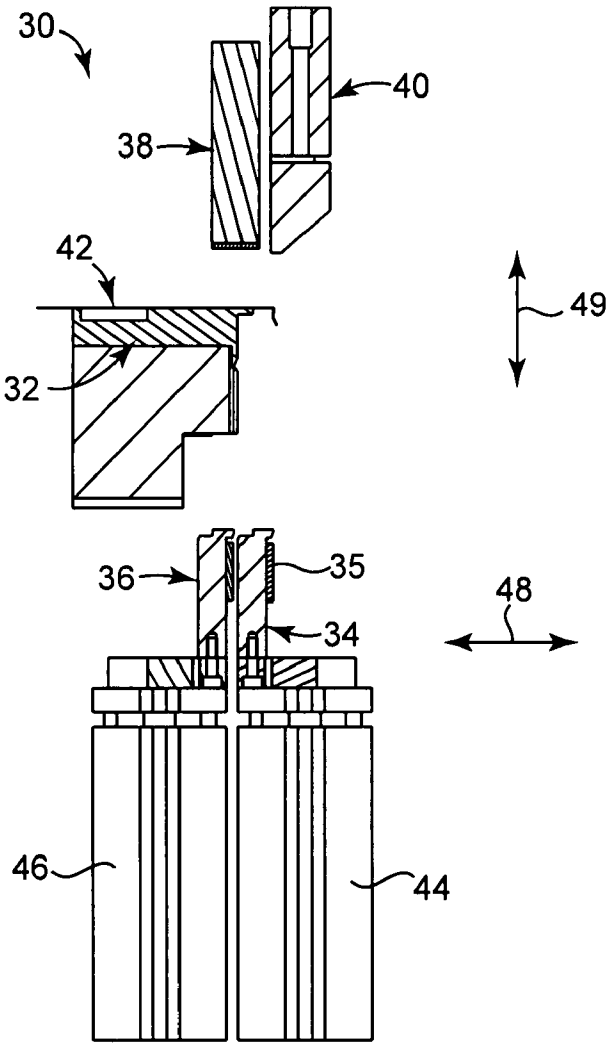
FIG. 20 is a cross-sectional schematic view of the bending apparatus of FIG. 16 showing a flange formed on the printing plate and the first and second anvils, mandrel, and clamping device each in a retracted position.

In FIG. 19, in particular, mandrel 40 is shown rotated around the center of radius of first anvil 34 and at the end of a bending motion and showing a flange formed on plate 42. That is, mandrel 40 is preferably designed to rotate around a point that coincides with the center of the radius of the forming surface of first anvil 34. A detail view of plate 42, clamping device 38, mandrel 40, supporting bed 32, and first anvil 34 at the end of the bending motion of the mandrel 38 is shown in FIG. 21. In FIG. 20 clamping device 38 and mandrel 40 are shown in the retracted position and first anvil 34 is shown in the retracted position after the completed bend.

Referring to FIG. 21 in particular, first anvil 34 includes optional plate 35 that is positioned relative to the radius of first anvil 34, as shown. The radius of first anvil 34 functions to provide a first bend in plate 42 and plate 35 functions to provide a second bend spaced from the first bend during a single bending rotation of mandrel 40. Plate 35 provides additional leverage to form the second bend under the force of the mandrel 40 during bending. Plate 35 is designed to provide the desired bend geometry and is preferably adjustable to provide different bend geometries with the same anvil. As shown, second anvil 36 preferably includes similar plate 37. Plates 35 and 37 are optional and not required. It is also noted that second anvil 14 of apparatus 10 described above may also include a plate functionally and structurally similar to plates 35 and 37 if desired.

Figure 23:
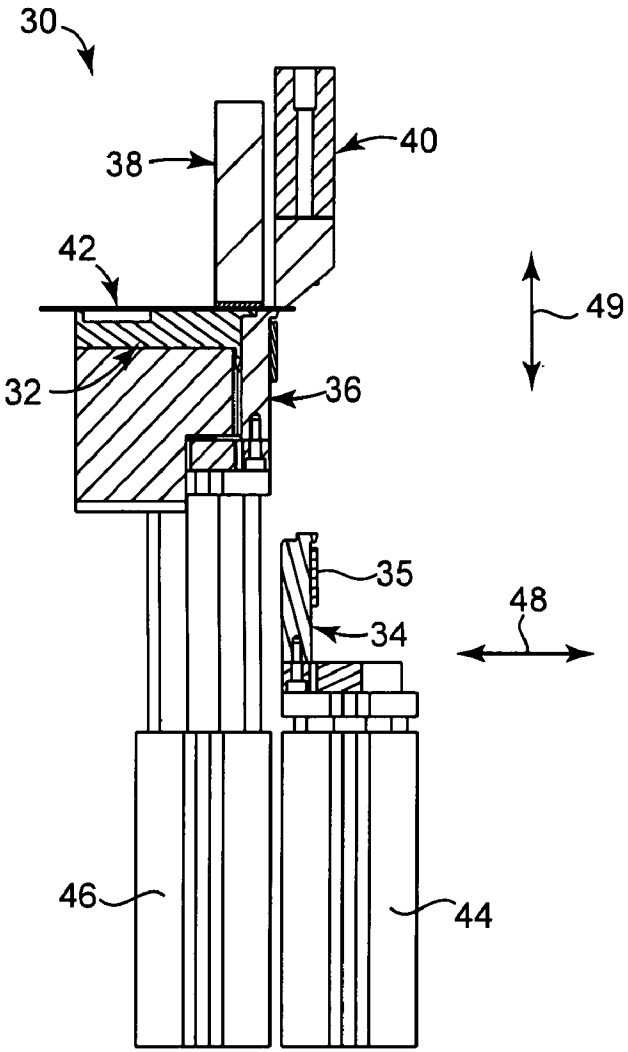
FIG. 23 is a cross-sectional schematic view of the bending apparatus of FIG. 16 showing the second anvil in a working position, the first anvil in a retracted position, the mandrel in a position ready to form a bend in the printing plate, and the clamping device in a clamped position.
Figure 22:
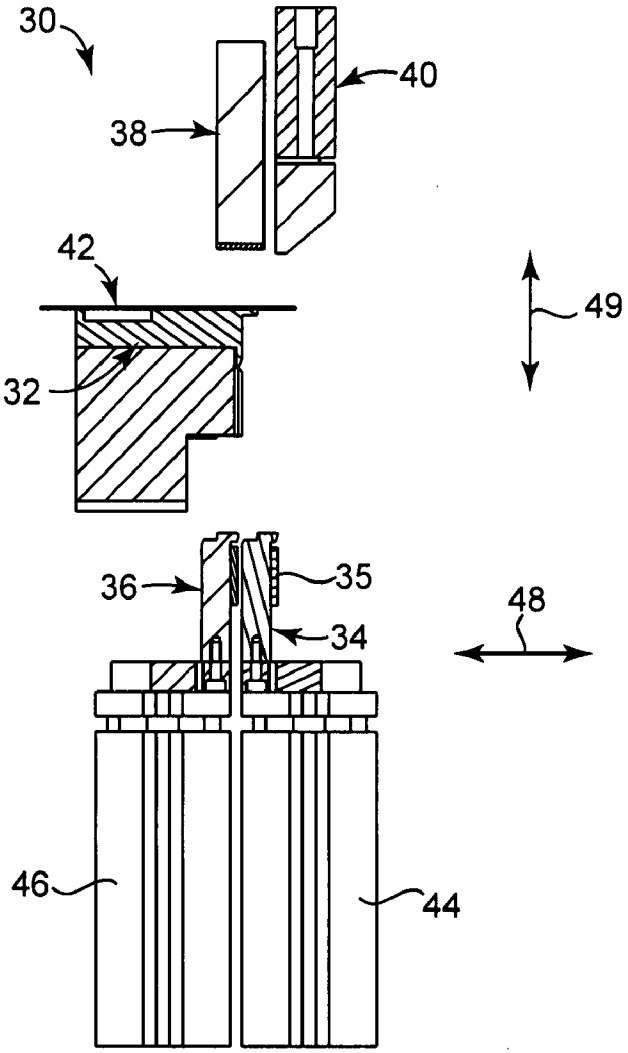
FIG. 22 is a cross-sectional schematic view of the bending apparatus of FIG. 16 showing a printing plate to be bent by the bending apparatus and the first and second moveable anvils, mandrel, and clamping device each in a retracted position.

In FIG. 22 apparatus 30 is shown with first and second anvils, 34 and 36, respectively, in the retracted position after forming a bend with first anvil 34. In FIG. 23, apparatus 30 is shown with plate 42 positioned for a bending operation using second anvil 36 having a forming surface having second radius different from the radius of the forming surface of first anvil 34. Clamping device 38 and mandrel 40 are in a retracted position relative to plate 42. In the configuration of apparatus 30 shown in FIG. 23, second anvil 36 has been translated linearly in the machine direction indicated by reference numeral 48 relative to the position of second anvil 36 shown in FIGS. 16-22 and is in a position ready to be moved to a working position relative to supporting bed 32. Any desired mechanism or device can be used to translate second anvil 36 along direction 48. Preferably first and second anvils, 34 and 36, respectively, are designed as a bank having any desired number of anvils that is translated along direction 48.

Figure 25:
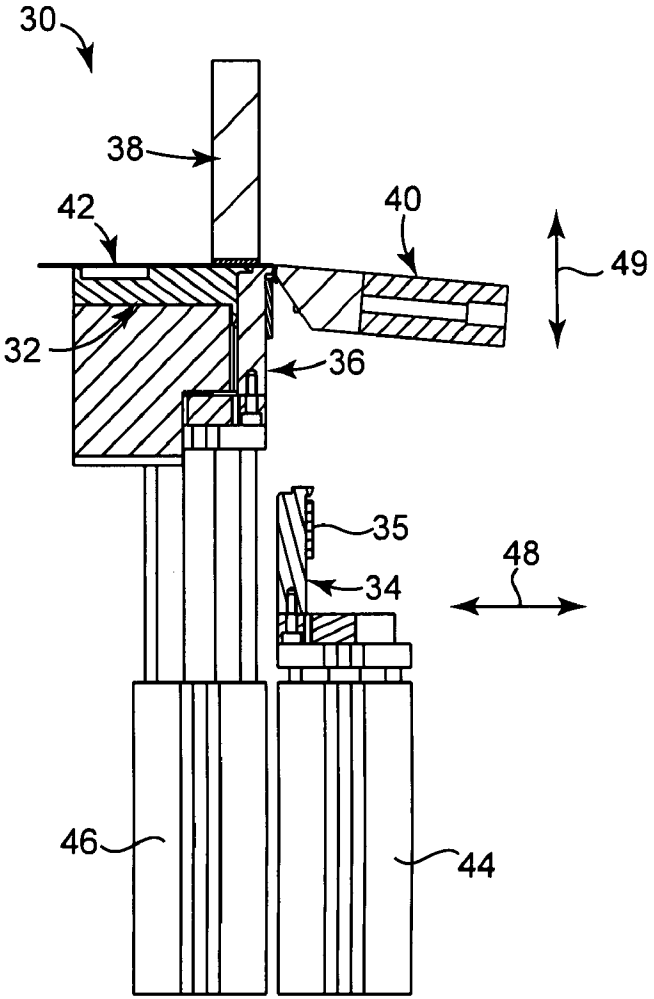
FIG. 25 is a cross-sectional schematic view of the bending apparatus of FIG. 16 showing the second anvil in a working position, the first anvil in a retracted position, the mandrel fully rotated around the forming surface of the second anvil to a desired bend angle, and the clamping device in a clamped position.
Figure 24:
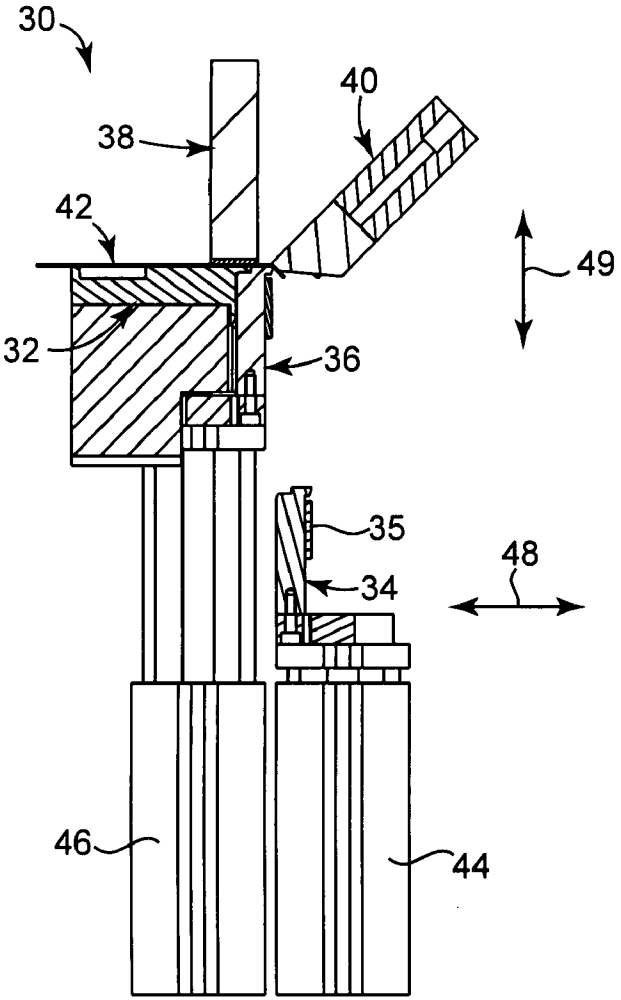
FIG. 24 is a cross-sectional schematic view of the bending apparatus of FIG. 16 showing the second anvil in a working position, the first anvil in a retracted position, the mandrel partially rotated around a forming surface of the second anvil, and the clamping device in a clamped position.

In FIG. 23 clamping device 38 is closed and mandrel 40 is in a position ready for bending plate 42 as clamped between supporting bed 32 and clamping device 38. Second anvil 36 is shown in the working position wherein second anvil 36 is nested with supporting bed 32. In the illustrated apparatus 30, second anvil 36 is moveable between the retracted and working positions along a linear path indicated by a machine direction identified by reference numeral 49 and as moved by linear actuator 46. Second anvil 36 can be designed to be move between the home and working positions along an arcuate, elliptical, and/or rotational path. FIGS. 24 and 25 show incremental steps of the bending operation.

Figure 27:
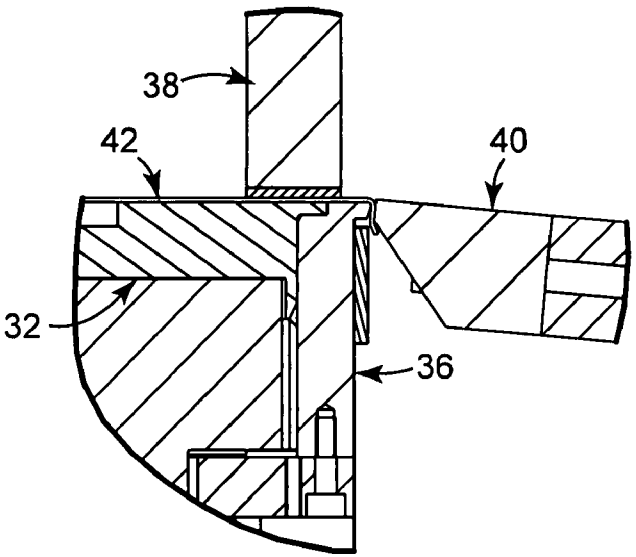
FIG. 27 is a detail view of the printing apparatus as shown in FIG. 25 at the completion of forming the flange on the printing plate.
Figure 26:
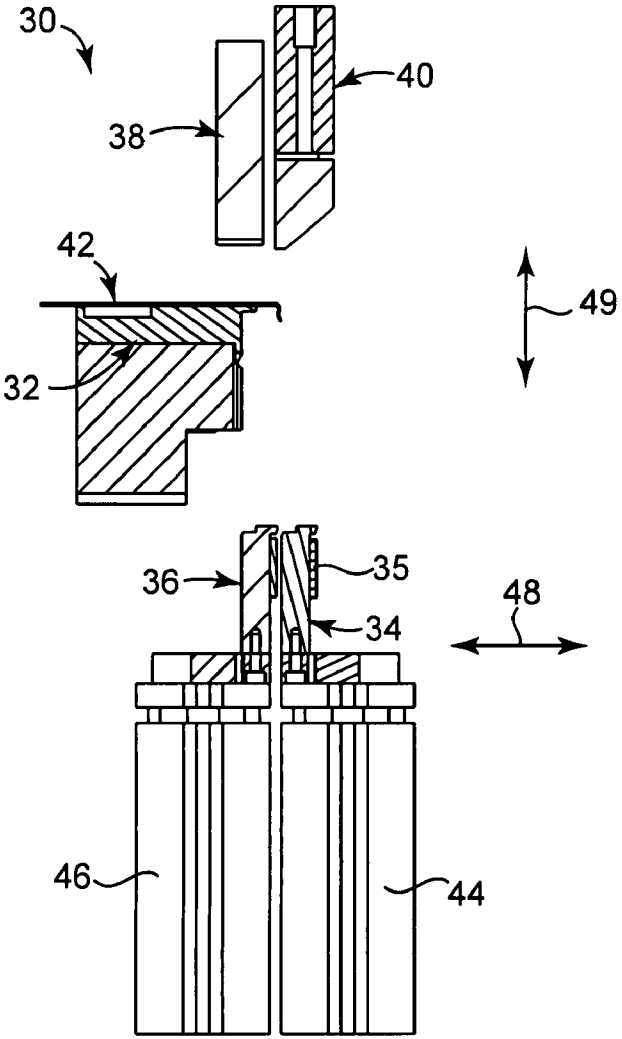
FIG. 26 is a cross-sectional schematic view of the bending apparatus of FIG. 16 showing a flange formed on the printing plate and the first and second anvils, mandrel, and clamping device each in a retracted position.

In FIG. 25 mandrel 40 is shown rotated around the radius of second anvil 36 and at the end of a bending motion and showing a flange formed on plate 42. Preferably, second anvil 36 (or any additional anvil of the bank of anvils) is positioned so the center of the radius of the forming surface of the second anvil 36 coincides with the location of the point about which mandrel 40 rotates. That is, each anvil of the bank of anvils is preferably moved to a working position where the center of the radius of the forming surface of an anvil coincides with the point about which mandrel 40 rotates. A detail view of plate 42, clamping device 38, mandrel 40, and second anvil 36 at the end of the bending motion of the mandrel 40 is shown in FIG. 27. In FIG. 26 clamping device 38 and mandrel 40 are shown in the retracted position after the completed bend.

Figure 29:
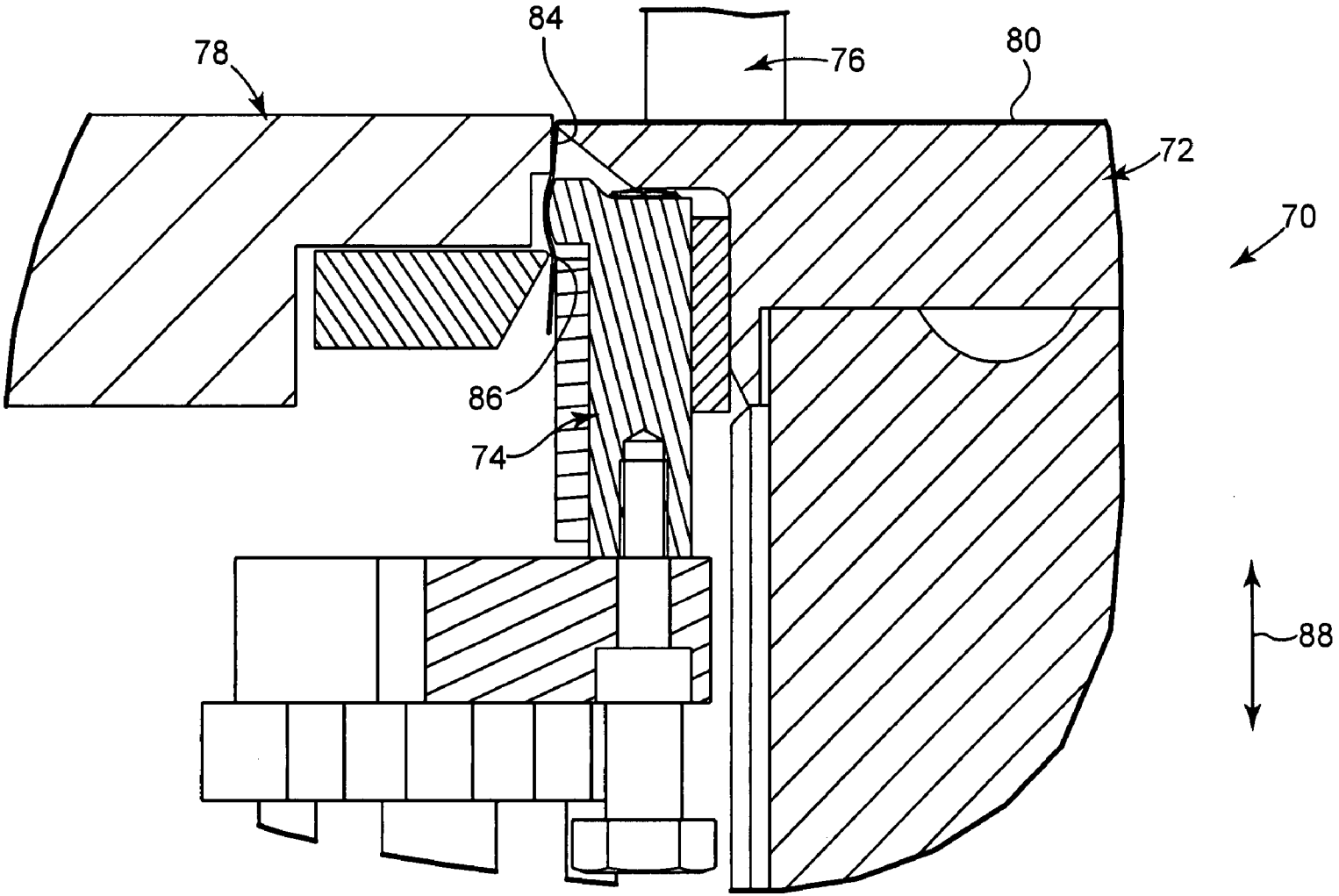
FIG. 29 is a schematic view of another exemplary bending apparatus in accordance with the present invention showing a moveable anvil and mandrel that comprise die elements and cooperate to form a desired geometric feature on a printing plate and illustrating a first step of a two step bending process wherein the mandrel is partially rotated around a forming surface of the anvil.
Figure 30:
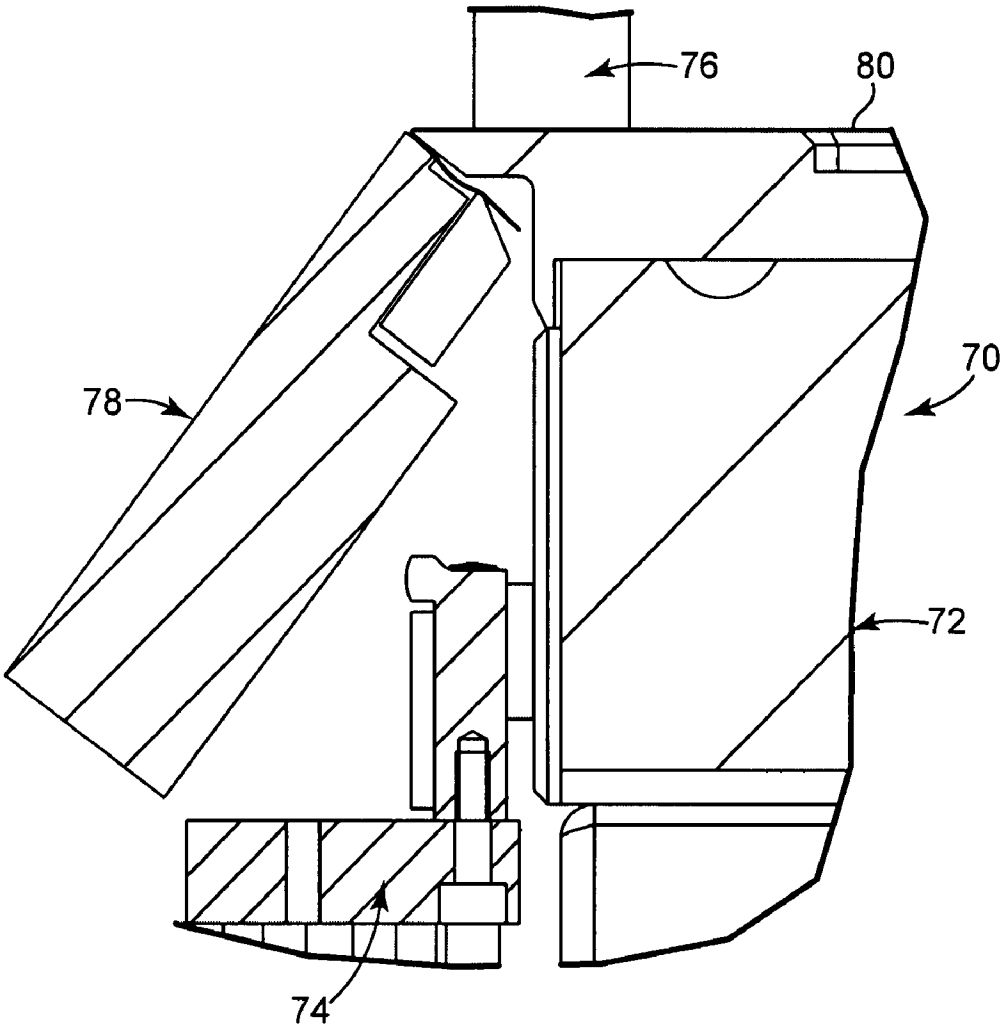
FIG. 30 is a schematic view of the apparatus of FIG. 29 showing the moveable anvil in a retracted position and illustrating a second step of the two step bending process wherein the mandrel is fully rotated around the forming surface of the anvil.

In FIGS. 29 and 30, another exemplary bending apparatus 70 in accordance with the present invention is schematically shown. Bending apparatus 70, as shown, includes first anvil 72 having a forming surface having a first radius and a supporting bed, second movable anvil 74, clamping device 76, mandrel 78, and a control system (not shown). Printing plate 80 is also shown positioned on the supporting bed of first anvil 72 and after a first bending operation in FIG. 29 and after a second bending operation in FIG. 30. Bending apparatus 70 can be designed in accordance with the designs of exemplary apparatuses 10 and 30 described above. That is, design elements and features from bending apparatuses 10 and 30 may be incorporated into apparatus 70 as desired.

Second moveable anvil 74 and mandrel 78 are designed to cooperatively function as a die to form a desired feature in a flange of a printing plate. As shown, second anvil 74 includes male die portion 82 and mandrel 78 functions as a female die. In FIG. 29, printing plate 80 is shown clamped against the supporting bed of first anvil 72 by clamping device 76. Second anvil 74 is shown in a working position. Mandrel 78 is shown rotated around the radius of the forming surface of the first anvil 72 to form a partial bend in printing plate 80 and to form an optional geometric feature from the cooperative action of the male die portion 82 and mandrel 78.

Further referring to FIG. 29, mandrel 78 includes first forming surface 84 and second adjustable forming surface 86. Mandrel 78 is shown rotated around the radius of the forming surface of the first anvil 72 to form a partial bend in printing plate 80 and to form an optional desired feature from the cooperative action of the male die portion 82 and first and second forming surfaces, 84 and 86, respectively of mandrel 78. In particular, first and second forming surfaces, 84 and 86, function to force printing plate 80 against male die portion 82 of mandrel 78 such as is illustrated in FIG. 29. Second forming surface 86 is adjustable and designed to be moveable relative to first forming surface 84 in any desired direction to adjust the geometry of the feature form. As shown, the formed feature comprises a dimple but any desired feature can be formed in printing plate 80.

Referring to FIG. 30, printing plate 80 is shown clamped against the supporting bed of first anvil 72 by clamping device 76. As compared to the position shown in FIG. 29, second anvil 74 has been linearly translated along a machine direction identified by reference numeral 88 wherein second anvil 74 is positioned in a retracted position. Mandrel 78 is shown further rotated around the forming surface of first anvil 72 thus further bending the flange being formed on printing plate 80. In this way, a two-step bending process is used. The first bending step bends the flange to a first angle and forms any desired geometric feature in the flange. The second step further bends the flange to a second angle greater than the first angle and may be overbent to provide compensation for springback effects. Such two-step bending process can be used with any of the bending apparatuses described herein.

The present invention has now been described with reference to several exemplary embodiments thereof. The entire disclosure of any patent or patent application identified herein is hereby incorporated by reference for all purposes. The foregoing detailed description has been provided for clarity of understanding only. No unnecessary limitations are to be understood therefrom. It will be apparent to those skilled in the art that changes can be made in the exemplary embodiments described without departing from the scope of the invention. Thus, the scope of the present invention should not be limited to the exemplary structures and methods described herein, but only by the structures and methods described by the language of the claims and the equivalents of those structures and methods.

What is claimed is:

1. An apparatus for forming a mounting flange on a printing plate, the apparatus comprising a bending device, the bending device comprising:

a supporting bed having a working surface that can position and support a printing plate relative to the bending device;

a first anvil comprising a first forming surface having a first radius, the first anvil positioned relative to the working surface of the supporting bed so a printing plate positioned on the working surface of the supporting bed can be bent around the forming surface of the first anvil to form a flange on the printing plate;

a clamping device positioned relative to the working surface of the supporting bed, the clamping device having a clamping surface movable between a first unclamped position where the clamping surface is spaced apart from the working surface of the supporting bed and a second clamped positioned where the clamping surface can contact a printing plate positioned on the working surface of the supporting bed to hold the printing plated during a bending operation to form a flange on the printing plate;

a mandrel positioned relative to the first forming surface of the first anvil, the mandrel having a body portion and a working surface capable of being controllably rotated about the first forming surface of the first anvil to form a flange on a printing plate when positioned on the working surface of the supporting bed and held by the clamping device;

a second anvil comprising a second forming surface having a second radius different from the first radius of the first forming surface of the first anvil, the second anvil moveable relative to the first anvil between a first retracted position where the first anvil is used to form a flange on a printing plate and a second working position where the second anvil is used to form a flange on a printing plate; and a control system that controls operation of one or more of the clamping device, mandrel, and second anvil.

2. The apparatus of claim 1, wherein the second anvil comprises an anvil of a bank of plural anvils, wherein each anvil of the bank of anvils comprises a forming surface having a radius distinct from the radiuses of the other anvils of the bank of anvils, each anvil of the bank of anvils moveable in a first direction relative to the first anvil between a first retracted position where the first anvil is used to form a flange on a printing plate and a second working position where each anvil is used to form a flange on a printing plate, each anvil of the bank of anvils moveable in a second direction generally orthogonal to the first direction to position each anvil relative to the first anvil and so each anvil can be positioned in the second working position.

3. The apparatus of claim 1, wherein the clamping device, mandrel, and second anvil each comprise one or more actuating devices controllable by the control system.

4. The apparatus of claim 3, wherein one or more of the actuating devices comprises a pneumatic actuating device.

5. The apparatus of claim 1, wherein the second radius of the second forming surface of the second anvil is larger than the first radius of the first forming surface of the first anvil.

6. The apparatus of claim 1, wherein a surface of the second anvil is nested with a surface of the first anvil when the second anvil is positioned in the second working position.

7. The apparatus of claim 1, wherein the center of the second radius of the second anvil is spaced apart from the center of the first radius of the first anvil when the second anvil is positioned in the working position.

8. The apparatus of claim 1, comprising a second bending device having plural anvils for forming mounting flanges on printing plates having different radiuses.

9. An apparatus for forming a mounting flange on a printing plate, the apparatus comprising a bending device, the bending device comprising:

a supporting bed having a working surface that can position and support a printing plate relative to the bending device;

a first anvil comprising a first forming surface having a first radius, the first anvil positioned relative to the working surface of the supporting bed so a printing plate positioned on the working surface of the supporting bed can be bent around the forming surface of the first anvil to form a flange on the printing plate;

a clamping device positioned relative to the working surface of the supporting bed, the clamping device having a clamping surface movable between a first unclamped position where the clamping surface is spaced apart from the working surface of the supporting bed and a second clamped positioned where the clamping surface can contact a printing plate positioned on the working surface of the supporting bed to hold the printing plated during a bending operation to form a flange on the printing plate;

a mandrel positioned relative to the first forming surface of the first anvil, the mandrel having a body portion and a working surface capable of being controllably rotated about the first forming surface of the first anvil to form a flange on a printing plate when positioned on the working surface of the supporting bed and held by the clamping device;

an absorber device comprising at least one resilient portion operatively positioned between the working surface of the mandrel and a body portion of the mandrel wherein the resilience of the resilient portion can be controllably adjusted;

a second anvil comprising a second forming surface having a second radius different from the first radius of the first forming surface, the second anvil moveable relative to the first anvil between a first retracted position where the first anvil is used to form a flange on a printing plate and a second working position where the second anvil is used to form a flange on a printing plate; and a control system that controls operation of one or more of the clamping device, mandrel, and second anvil.

10. The apparatus of claim 9, wherein the resilient portion of the absorber device comprises a pneumatic bladder.

11. The apparatus of claim 9, wherein the absorber device comprises plural spaced apart resilient portions.

12. The apparatus of claim 9, wherein the clamping device, mandrel, absorber device, and second anvil each comprise one or more actuating devices controllable by the control system.

13. The apparatus of claim 9, wherein the second radius of the second forming surface of the second anvil is larger than the first radius of the first forming surface of the first anvil.

14. The apparatus of claim 9, wherein a surface of the second anvil is nested with a surface of the first anvil when the second anvil is positioned in the second working position.

15. The apparatus of claim 9, wherein the center of the second radius of the second anvil is spaced apart from the center of the first radius of the first anvil when the second anvil is positioned in the working position.

16. The apparatus of claim 9, comprising a second bending device having plural anvils for forming mounting flanges on printing plates having different radiuses.

17. An apparatus for forming a mounting flange on a printing plate, the apparatus comprising a bending device, the bending device comprising:

a supporting bed having a working surface that can position and support a printing plate relative to the bending device;

a first moveable anvil comprising a first forming surface having a first radius, the first anvil moveable relative to the working surface of the supporting bed so the forming surface of the first anvil can be positioned relative to the working surface of the supporting bed so a printing plate positioned on the working surface of the supporting bed can be bent around the first radius of the first anvil to form a flange on the printing plate;

a clamping device positioned relative to the working surface of the supporting bed, the clamping device having a clamping surface movable between a first unclamped position where the clamping surface is spaced apart from the working surface of the supporting bed and a second clamped positioned where the clamping surface can contact a printing plate positioned on the working surface of the supporting bed to hold the printing plated during a bending operation to form a flange on the printing plate;

a mandrel positioned relative to the first forming surface of the first anvil, the mandrel having a body portion and a working surface capable of being controllably rotated about the first forming surface of the first anvil to form a flange on a printing plate when positioned on the working surface of the supporting bed and held by the clamping device;

a second movable anvil comprising a second forming surface having a second radius different from the first radius of the first forming surface, the second anvil moveable relative to the working surface of the supporting bed between a first retracted position and a second working position where the second anvil is used to form a flange on a printing plate; and a control system that controls operation of one or more of the clamping device, mandrel, and second anvil.

18. The apparatus of claim 17, wherein the first and second anvils comprise a moveable bank of plural anvils.

19. The apparatus of claim 17, wherein each of the first and second anvils are moveable along a first direction and a second direction generally orthogonal to the first direction.

20. A method of forming a mounting flange on a printing plate, the method comprising:

providing the apparatus of claim 9;

positioning the clamping device in the first unclamped position;

positioning a printing plate on the working surface of the supporting bed;

positioning the clamping device in the second clamped position thereby clamping the printing plate to the working surface of the supporting bed;

positioning the second anvil in the second working position of the second anvil wherein the second anvil is nested with the first anvil; and rotating the mandrel about the center of the first radius of the first anvil.

21. The method of claim 20, comprising adjusting the resilience of the resilient portion of the absorber device.

22. The method of claim 21, comprising increasing resilience of the resilient portion of the absorber device while rotating the mandrel about the center of the radius of the first anvil.

23. The method of claim 22, comprising pressurizing the resilient portion of the absorber device.

* * * * *